US009775771B2

(12) United States Patent
Stemple et al.

(10) Patent No.: US 9,775,771 B2
(45) Date of Patent: Oct. 3, 2017

(54) APPARATUS FOR REANIMATION OF A PATIENT

(75) Inventors: Guenter Stemple, Kaufering (DE); Dieter Gellert, Kaufering (DE); Michael Heller, Kaufering (DE)

(73) Assignee: GS Elektromedizineische Geraete G. Stemple GmbH, Kaufering (DE)

( * ) Notice: Subject to any disclaimer, the term of this patent is extended or adjusted under 35 U.S.C. 154(b) by 962 days.

(21) Appl. No.: 13/422,263

(22) Filed: Mar. 16, 2012

(65) Prior Publication Data

US 2012/0238922 A1 Sep. 20, 2012

(30) Foreign Application Priority Data

Mar. 17, 2011 (DE) ..... 10 2011 014 304

(51) Int. Cl.
*A61H 31/00* (2006.01)

(52) U.S. Cl.
CPC ..... *A61H 31/006* (2013.01); *A61H 31/00* (2013.01); *A61H 31/004* (2013.01); *A61H 31/005* (2013.01); *A61H 31/008* (2013.01); *A61H 2201/0119* (2013.01); *A61H 2201/0157* (2013.01); *A61H 2201/0192* (2013.01); *A61H 2201/1215* (2013.01); *A61H 2201/149* (2013.01); *A61H 2201/1619* (2013.01); *A61H 2201/1664* (2013.01); *A61H 2201/1685* (2013.01); *A61H 2201/5007* (2013.01); *A61H 2201/5043* (2013.01); *A61H 2201/5064* (2013.01); *A61H 2201/5069* (2013.01); *A61H 2201/5097* (2013.01); *A61H 2203/04* (2013.01); *A61H 2203/0456* (2013.01); *A61H 2205/084* (2013.01)

(58) Field of Classification Search
CPC .... A61H 2201/5051; A61H 2201/0157; A61H 23/00; A61H 23/002; A61H 23/006; A61H 23/02; A61H 2205/00; A61H 2203/04; A61H 2203/0456; A61H 31/00; A61H 2031/001; A61H 2031/002; A61H 2031/003; A61H 31/004; A61H 31/005; A61H 31/006; A61H 31/007; A61H 31/008; A61H 2205/084; A61H 2201/5058; A61H 2201/5069
See application file for complete search history.

(56) References Cited

U.S. PATENT DOCUMENTS

| | | | | | |
|---|---|---|---|---|---|
| 978,760 | A | * | 12/1910 | Langworthy | A61F 5/04 601/112 |
| 3,254,645 | A | * | 6/1966 | Rand et al. | 601/97 |
| 3,277,887 | A | * | 10/1966 | Thomas | 601/106 |
| 3,364,925 | A | * | 1/1968 | Barkalow | 601/106 |
| 3,489,140 | A | | 1/1970 | Mullikin | |

(Continued)

FOREIGN PATENT DOCUMENTS

| | | | | |
|---|---|---|---|---|
| WO | WO 2009/136831 A1 | | 11/2009 | |
| ZA | WO 2004058136 A1 | * | 7/2004 | A61H 31/006 |

*Primary Examiner* — Justine Yu
*Assistant Examiner* — Tu Vo
(74) *Attorney, Agent, or Firm* — Crowell & Moring LLP

(57) ABSTRACT

An apparatus for reanimation of a patient that includes a plunger driven by a drive to perform a compressive massage on the patient's body, a position measuring device that measures the respective position of the plunger during its compressive massaging motion, and a holding device for the drive and the plunger.

23 Claims, 19 Drawing Sheets

(56) References Cited

U.S. PATENT DOCUMENTS

| | | | | | |
|---|---|---|---|---|---|
| 3,552,390 | A * | 1/1971 | Muller | 601/97 | |
| 3,779,249 | A * | 12/1973 | Semler | 606/201 | |
| 3,985,126 | A * | 10/1976 | Barkalow | 601/106 | |
| 4,297,556 | A * | 10/1981 | Taylor | 200/330 | |
| 4,509,528 | A * | 4/1985 | Sahota | 600/504 | |
| 5,304,186 | A * | 4/1994 | Semler et al. | 606/151 | |
| 5,304,201 | A * | 4/1994 | Rice | A61B 17/132 | 606/151 |
| 5,327,887 | A * | 7/1994 | Nowakowski | 128/204.21 | |
| 5,351,676 | A * | 10/1994 | Putman | B25J 9/042 | 200/5 R |
| 5,597,146 | A * | 1/1997 | Putman | A61B 90/50 | 248/176.2 |
| 5,645,522 | A * | 7/1997 | Lurie et al. | 601/43 | |
| 6,290,660 | B1 * | 9/2001 | Epps et al. | 601/41 | |
| 6,648,841 | B1 * | 11/2003 | Sessler | 601/41 | |
| 8,002,720 | B2 * | 8/2011 | Hansen et al. | 601/41 | |
| 2003/0135085 | A1 * | 7/2003 | Bassuk et al. | 600/16 | |
| 2008/0092677 | A1 * | 4/2008 | Tjolsen et al. | 74/23 | |
| 2008/0097261 | A1 | 4/2008 | Hansen et al. | | |
| 2009/0314923 | A1 * | 12/2009 | Timoszyk | A61G 12/004 | 248/647 |
| 2010/0185127 | A1 * | 7/2010 | Nilsson et al. | 601/41 | |
| 2010/0198118 | A1 * | 8/2010 | Itnati | 601/41 | |

* cited by examiner 5
57
35
31
34
36
32
48
33
41
33
40
39
30

20
94
3
14
13
1
36
34
68
32
64
48
31
58
35
57
47
49

34
51
21
6
22
10
52
14
36

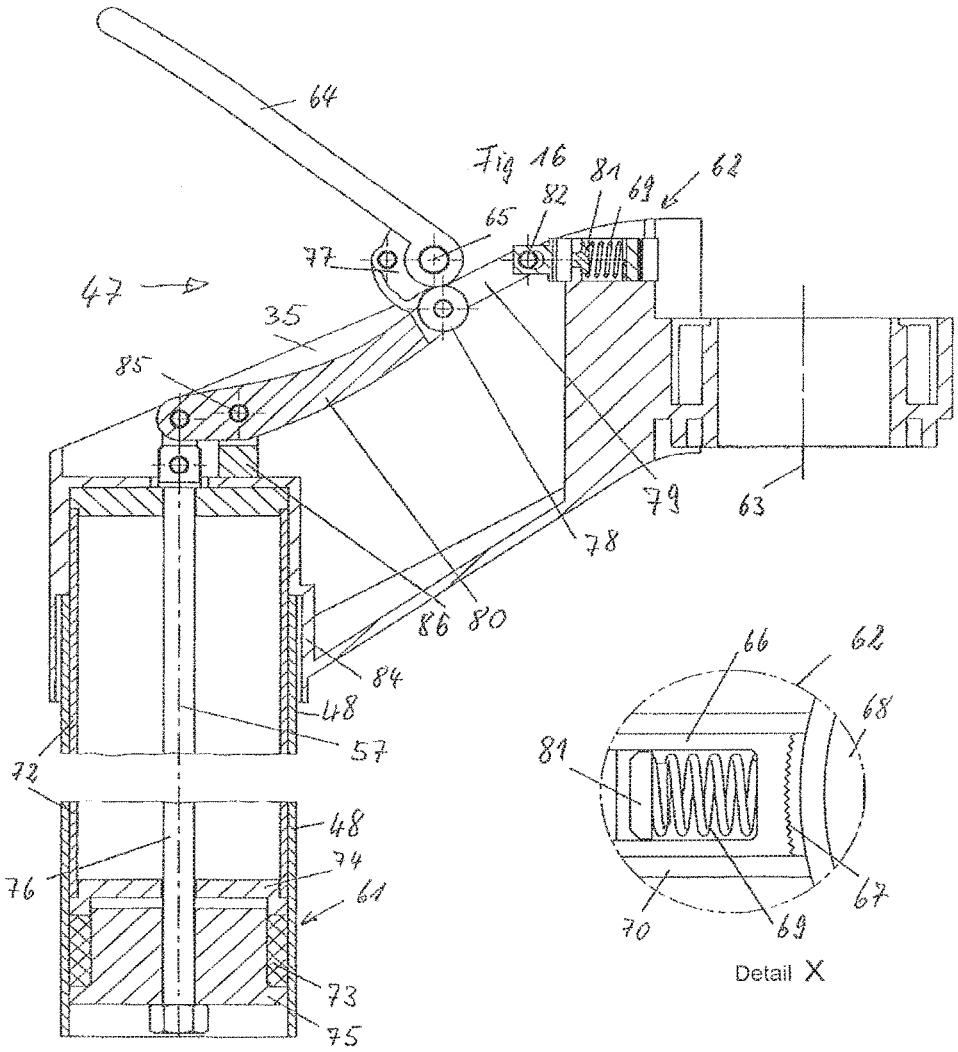
Cross-section along line A-A
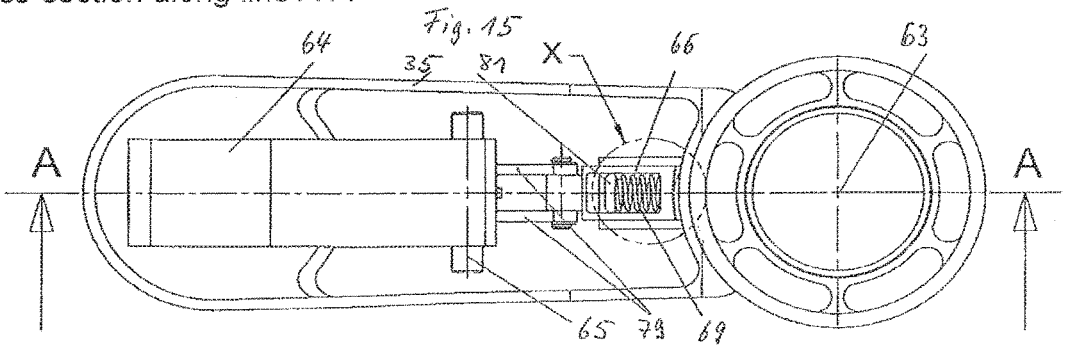

Fig. 18
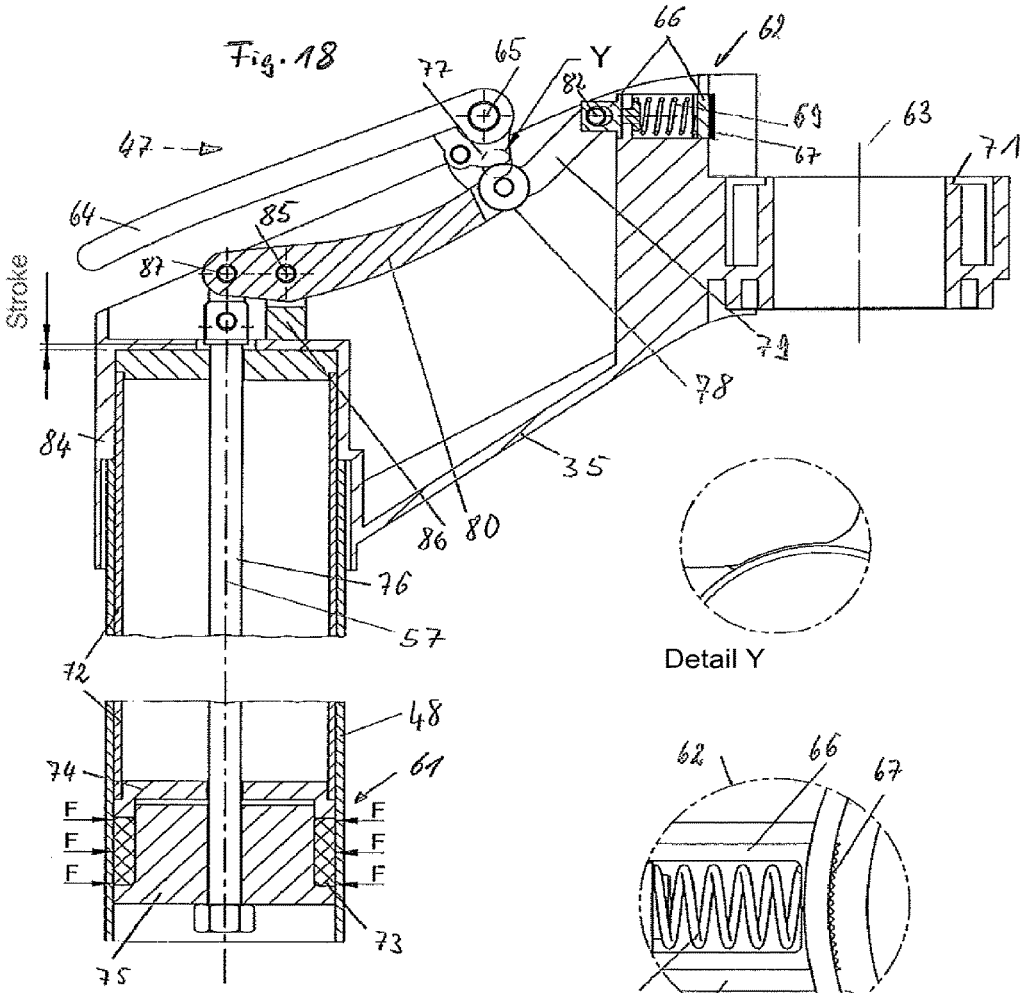
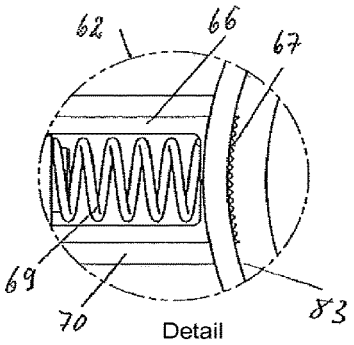
Fig 17
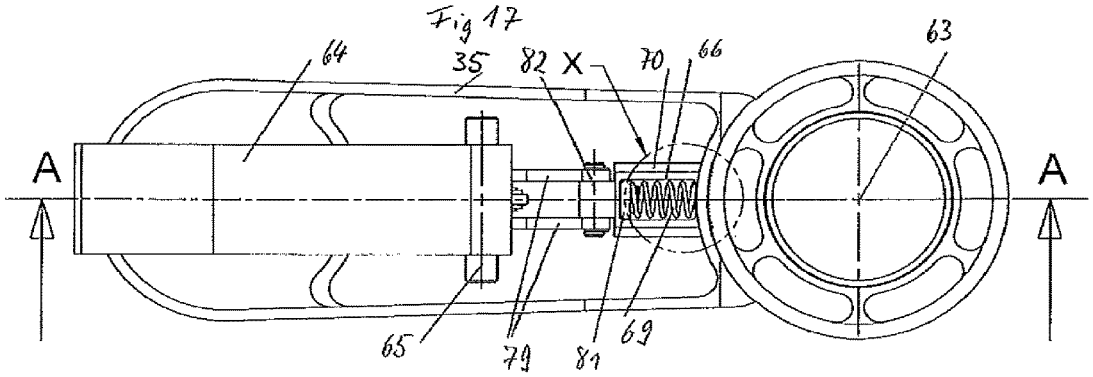

APPARATUS FOR REANIMATION OF A PATIENT

CROSS REFERENCE TO RELATED APPLICATIONS

This application claims priority under 35 U.S.C. §119 to German Patent Application No. 10 2011 014 304.1, filed Mar. 17, 2011, the entire disclosure of which is herein expressly incorporated by reference.

BACKGROUND AND SUMMARY OF THE INVENTION

The invention relates to an apparatus for reanimation of a patient. Reanimation using cardiopulmonary resuscitation (CPR) is known as a way of increasing the chances of survival in cases of cardiac arrest. The aim thereby is to achieve a sufficient flow of blood containing oxygen to essential organs by exerting extreme pressure on the patient's chest, in combination with artificial respiration. A device for such reanimation treatment, with which compressive massage in the chest region is performed on the patient's body with the aid of an electromotor, is known from WO 2009/136831. The electromotive drive causes the plunger to move back and forth, thus performing mechanical compressive massage on the patient's body.

The object of the invention is to provide an apparatus of this kind, with which efficacious CPR treatment of the patient is achieved and which is also simple to operate.

With this invention, an patient reanimation apparatus is proposed that comprises a plunger driven by a drive means to perform compressive massage on the patient's body. A position measuring device may be provided, with which the respective position of the plunger during compressive massaging motion is detected. A securing device is used to secure the patient during the compressive massage. A holding device for the drive means and the plunger is provided, wherein the drive means and the plunger can form an assembly on the holding device and are provided in vertically adjustable form, preferably on a cross-member. The holding device may also comprise a curved support that extends substantially along a 90° arc.

In the invention, the holding device on which the drive means and the plunger are mounted is supported on a reanimation board. To that end, the cross-member or curved support may be supported vertically adjustably on the reanimation board, and/or the assembly which receives the drive means and the plunger may be disposed vertically adjustably on the cross-member or curved support. One pillar may be provided in order to support the cross-member on the reanimation board, or two pillars may be provided. The one pillar or the two pillars may be attachable to the reanimation board on which the patient lies during treatment with the plunger.

The reanimation board, the cross-member and the one or both pillars, or the reanimation board and the curved support preferably form a force-locked or positive engagement structure, wherein the positive engagement can be produced with suitable locking and latching between the components of the structure. When compressive massage is performed with the plunger, the forces exerted are absorbed by the aforementioned structure.

In the embodiment in which a vertical pillar is provided to support the horizontally extending cross-member, or in which the drive means is provided on the curved support, this pillar or curved support can be advantageously mounted rotatably and/or movably about a vertical axis in order to set the desired treatment position on the reanimation board. For treatment with the plunger, the cross-member is fixed in a suitable rotation angle position over the pillar, and a suitable locking mechanism is fixed non-rotatingly on the reanimation board. The one pillar or the curved support may be detachably fixed to the reanimation board, in particular by means of a plug and snap connection. The cross-member borne by the one pillar is preferably articulated, the cross-member having at least two articulated arms connected to each other by an articulated joint. The one articulated arm is preferably mounted to the pillar at the top end of the pillar, the connection to the pillar preferably being swivelable and the swivelable connection being locked during treatment of the patient. The drive means and the plunger are disposed on the other articulated arm. The plunger is preferably disposed at the free end of that other articulated arm. The curved support, also, is preferably designed to be hingeable about horizontal axes of articulation.

The reanimation board on which the patient lies during treatment may be embodied in multiple parts, in particular in two parts and can be taken apart. The board parts can be joined together by means of suitable plug and snap-locking means. However, it is also possible to use an integral reanimation board. Pivotable support plates may be provided on the reanimation board. The support plates are used to support the holding device. The reanimation board may also be embodied as a stretcher, in particular a mobile stretcher.

The reanimation board may have a recess for a base plate, to which a pillar or to which both pillars must be attached. The base plate is preferably disposed on one board part and during treatment is located underneath the chest region on which the plunger exerts the required pressure during reanimation treatment. Guide mechanisms for lateral insertion of the base plate may be provided in the region of the recess. The base plate can be secured in the desired position on the reanimation board against movement by means of a suitable catch mechanism.

In this embodiment of the invention, the base plate and the holding device connected to the base plate form a structure that is force-locked and in positive engagement during the treatment, and which can absorb the forces exerted by the plunger during compressive massage. In order to fix the patient in place during the reanimation treatment, straps for securing the patient may be provided on the reanimation board. The base plate can also be used as an integral reanimation board.

In another embodiment of the invention, two lateral pillars may be provided to support the cross-member, between which the patient may be laterally secured when lying on the reanimation board during compressive massage treatment. Depending on the size of the patient's body, the two pillars may be locked in different fixing positions on the reanimation board. A cross-member provided with a holder for the drive means and the plunger can be supported vertically adjustably on the two pillars. The cross-member can also be adjustable in length. In this way, the device can be adjusted to different body sizes of patient to be treated, in particular for laterally securing the patient during the compressive massage treatment. By means of the holder, it is also possible for the drive means and the plunger, which as already described may be embodied as one assembly, to be advantageously held in place on the cross-member in a vertically adjustable manner. This also makes it possible to adjust for different sizes of patient, especially in the chest region to be treated.

The plunger and the drive means are held in place by means of an anti-rotation means on the cross-member or curved support. A display device for displaying reanimation progress may also be provided, said display device preferably being disposed on the top side of the holding device. The drive means preferably includes an electric motor, the torque of which is converted by a transmission gear into compressive massaging motion, which is a substantially linear back-and-forth motion. In order to detect the position of the plunger during compressive massaging motion, the rotation angle position of the motor armature or the position of a transmission part can be measured by means of the position measuring device in order to determine the respective position of the plunger from these measurement results. The position of the plunger can be used to control the motor.

The transmission part may be a transmission part that transfers the rotational movement of the electric motor, for example a drive belt, which transfers the rotational movement of the electric motor to another transmission part in which the rotational movement is converted into the linear movement. The transmission part which transfers the rotational movement of the electric motor may also be a gear wheel whose respective rotation angle position is detected. The electric motor is preferably a reversing electric motor.

Other objects, advantages and novel features of the present invention will become apparent from the following detailed description of one or more preferred embodiments when considered in conjunction with the accompanying drawings.

BRIEF DESCRIPTION OF THE DRAWINGS

Embodiments of the invention shall now be described in detail with reference to the Figures, in which FIG. 15 shows a plan view of an embodiment of a central locking mechanism, in the open position, FIG. 16 shows a cross-sectional view along line A-A in FIG. 15, FIG. 17 shows the locking mechanism of FIGS. 15 and 16 in a closed locking position, FIG. 18 shows a cross-sectional view along line A-A in FIG. 17.

DETAILED DESCRIPTION OF THE DRAWINGS

The embodiments shown are designed as electromechanical devices for reanimating patients with cardiac arrest. Cardiac massage can be carried out autonomously over a long period with such devices. The devices shown have a reanimation board 9 on which a patient is laid for compressive massage, as shown schematically in FIG. 3.

Figure 1:
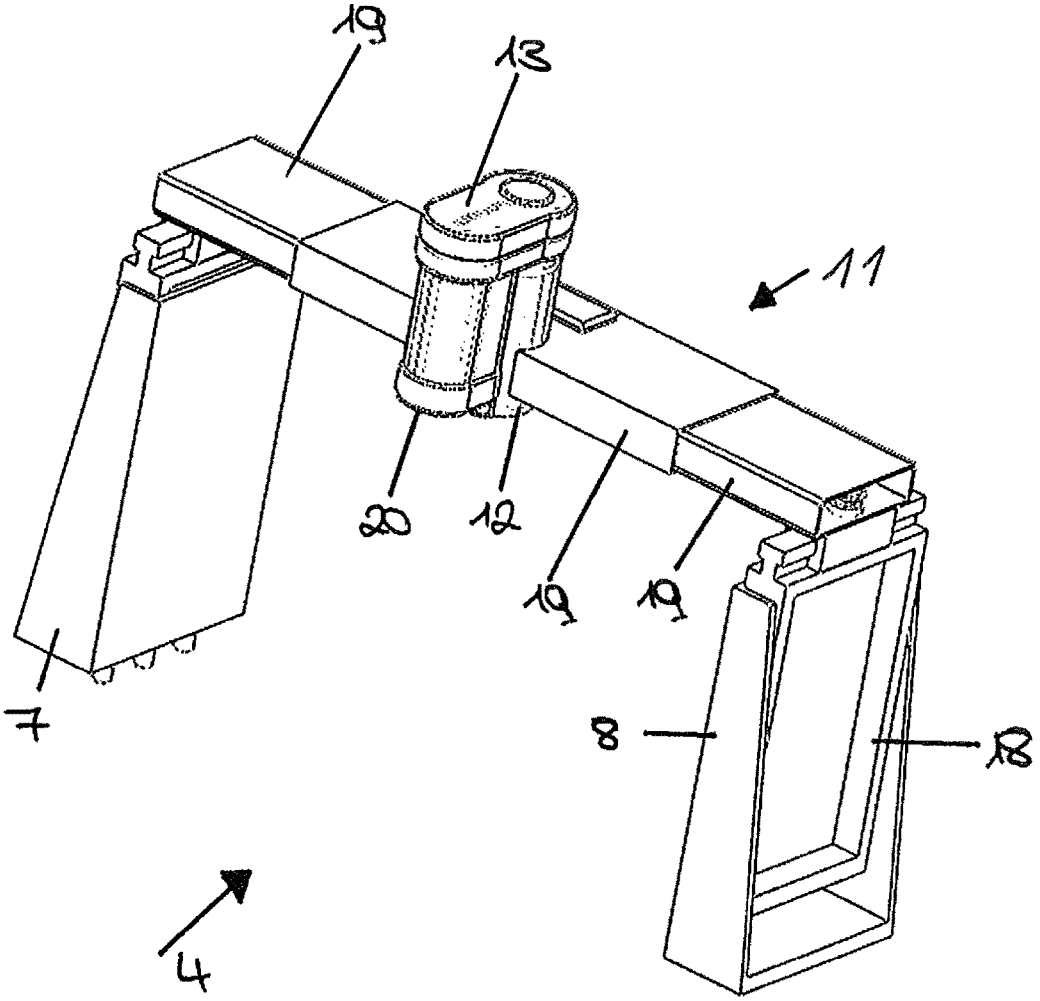
FIG. 1 shows components of a first embodiment of the invention assembled to form a portal.
Figure 2:
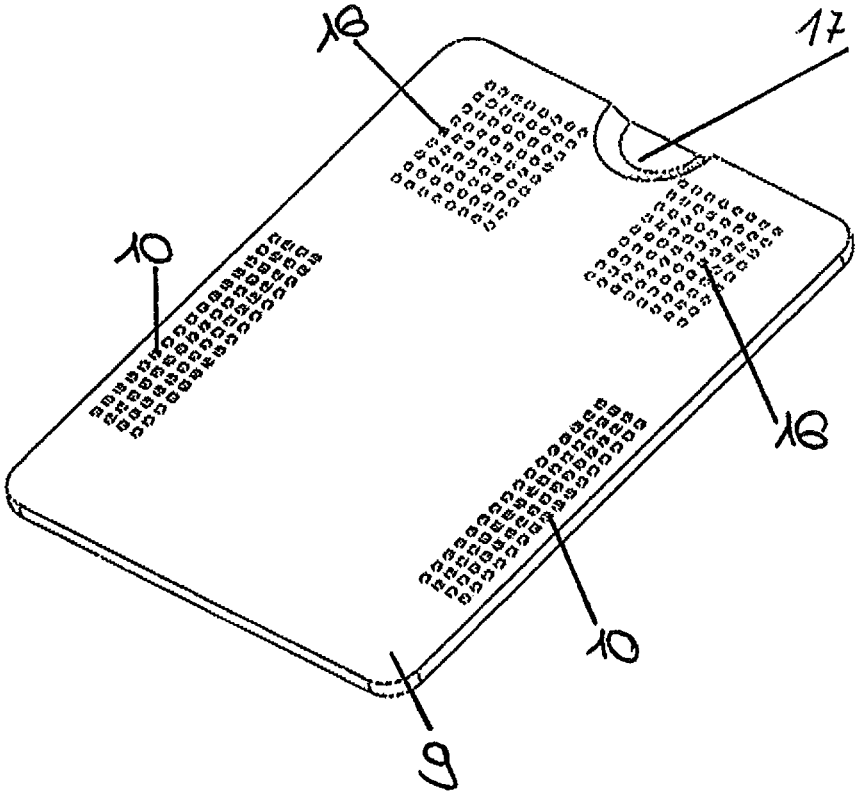
FIG. 2 shows a reanimation board used in the embodiment.
Figure 3:
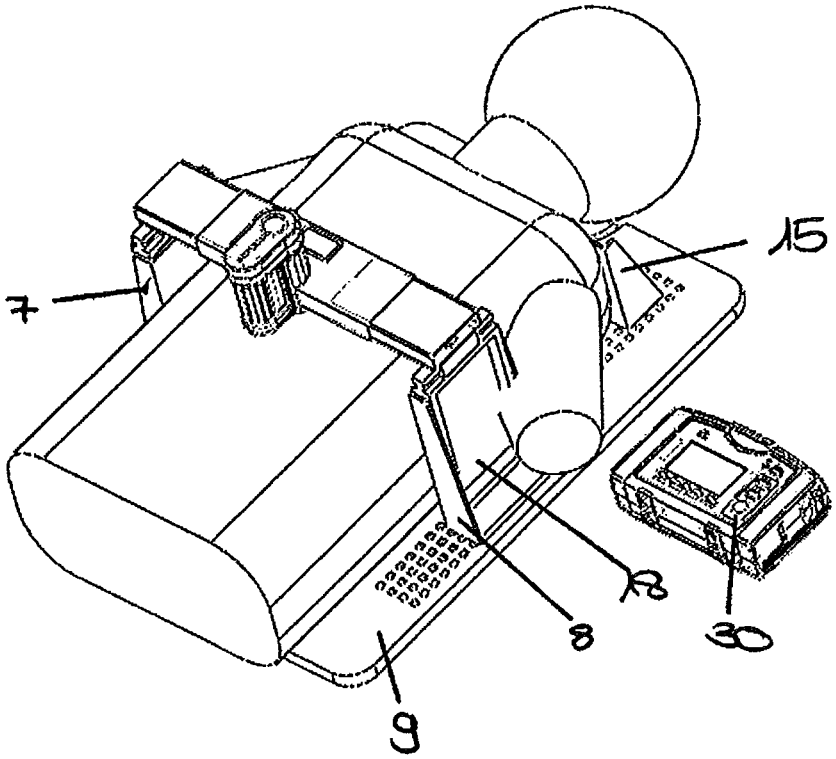
FIG. 3 shows the embodiment with a schematically represented patient's body.
Figure 4:
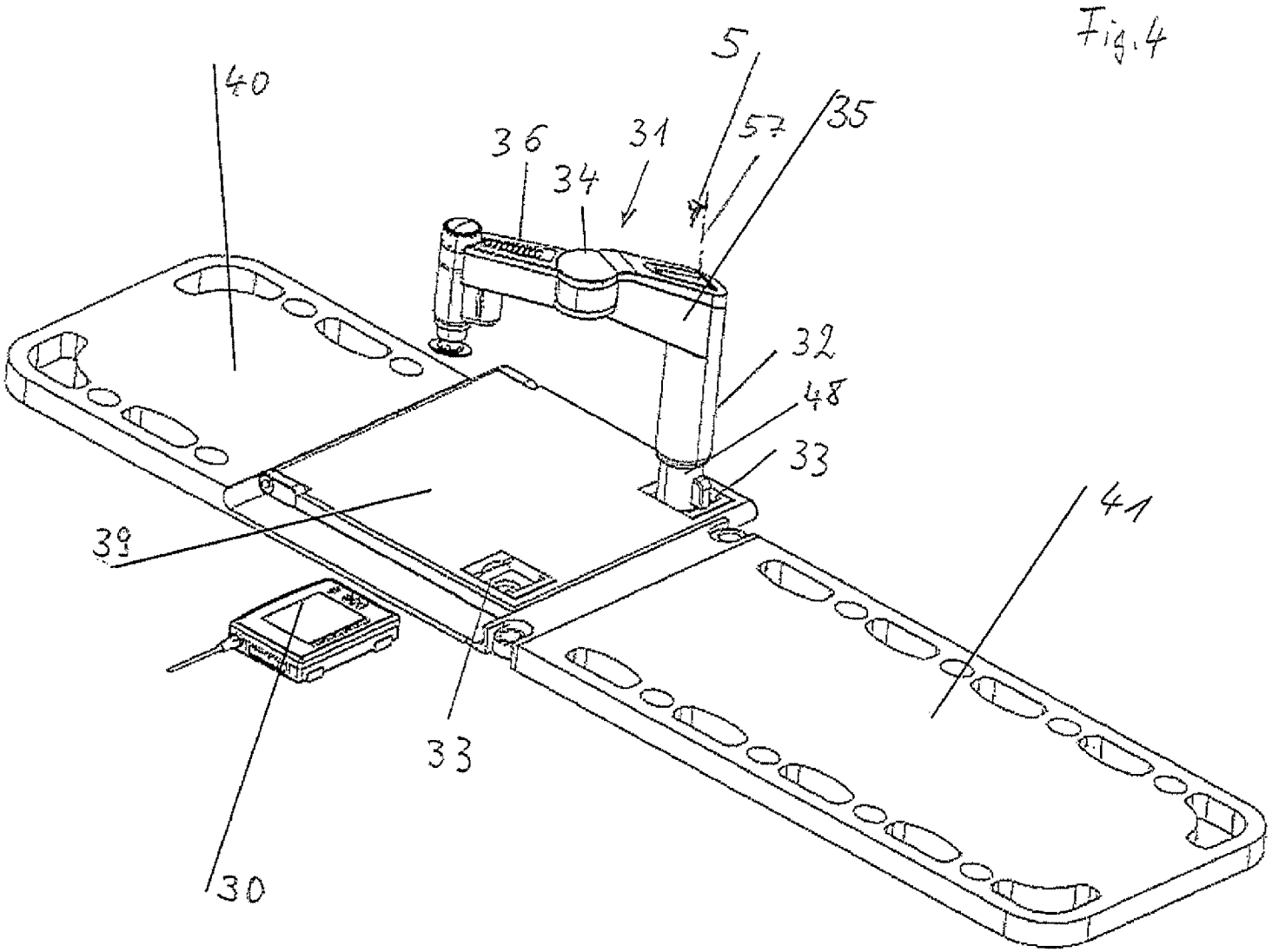
FIG. 4 shows a second embodiment of the invention.
Figure 5:
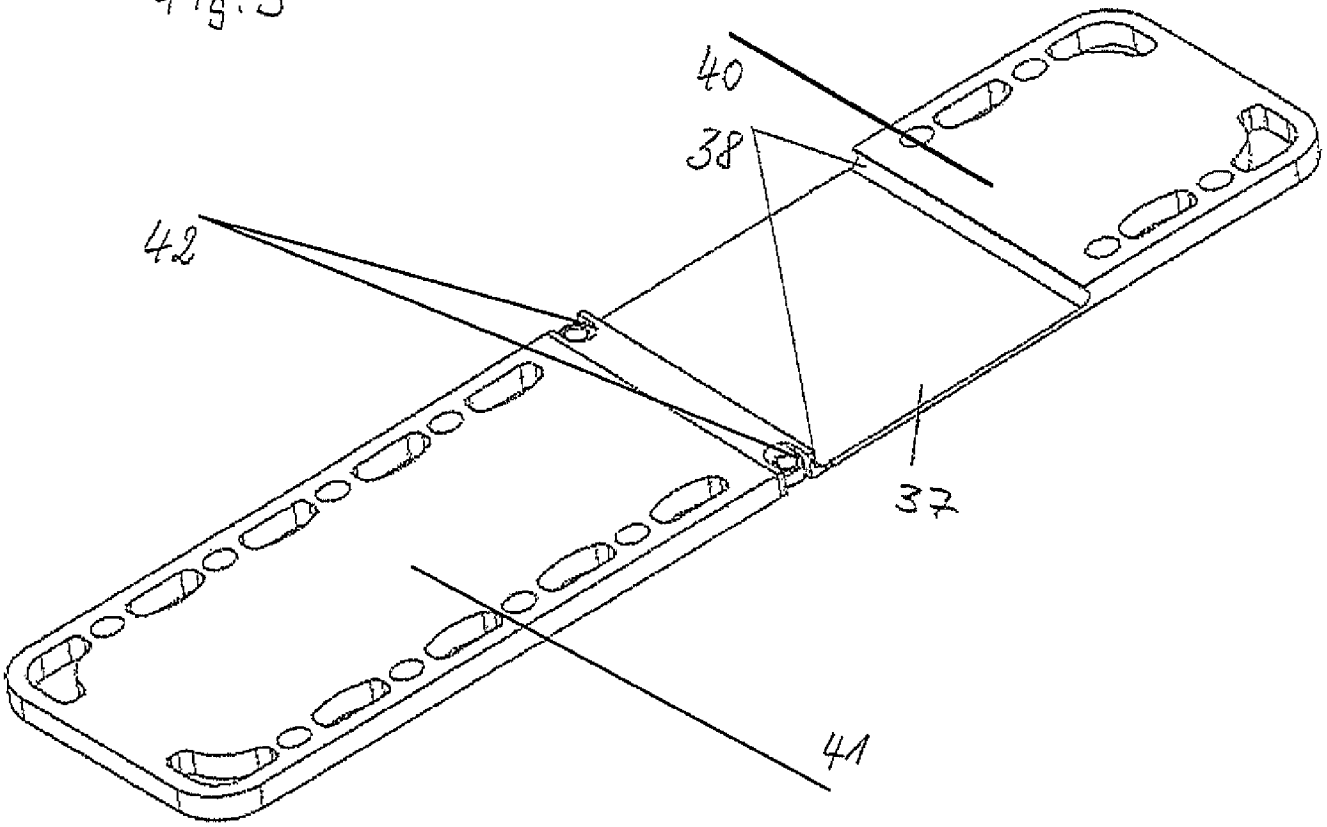
FIG. 5 shows a multipart reanimation board which is used in the second embodiment.
Figure 6:
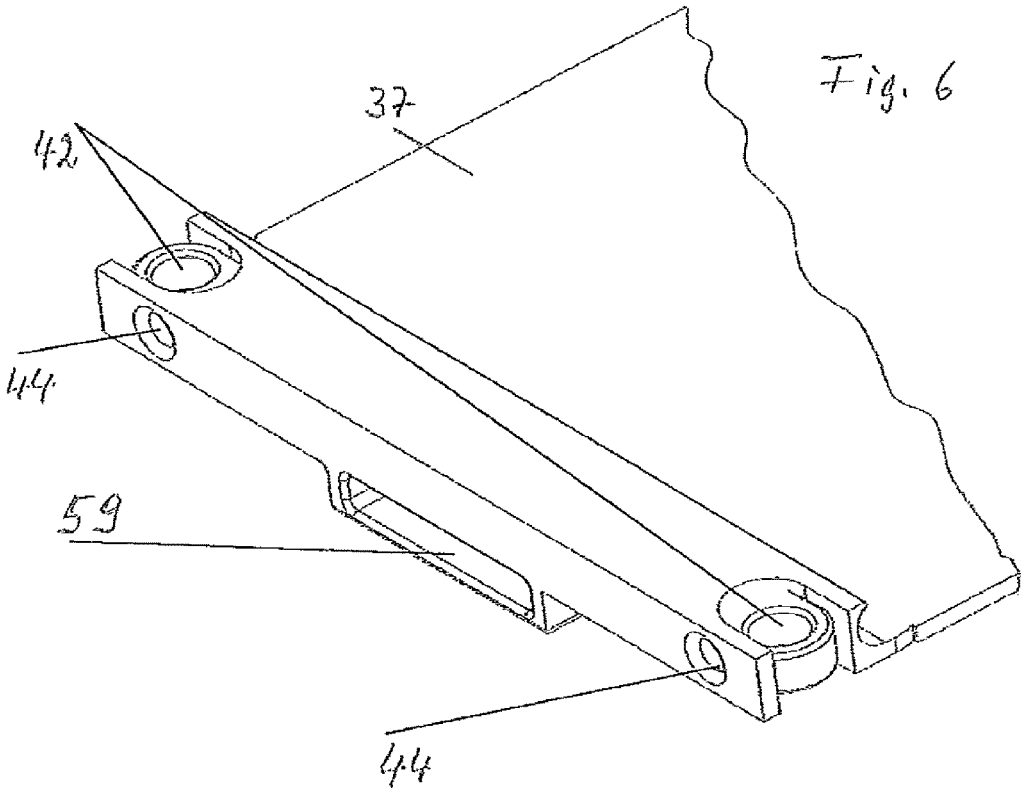
FIG. 6 shows connection points on a board part.
Figure 7:
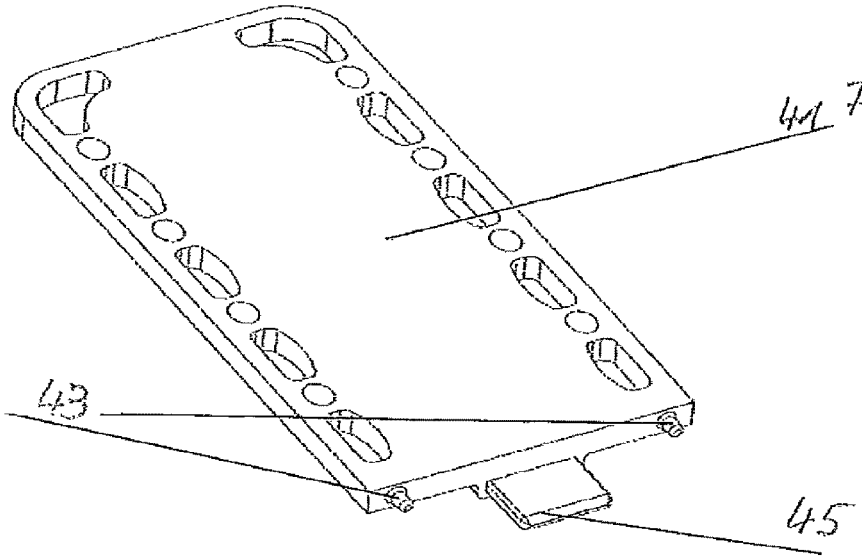
FIG. 7 shows connection points on another board part.

In the embodiments in FIGS. 1-3, a holding device 4 embodied as a portal is provided. Said holding device 4 has lateral pillars 7, 8, between which the patient is placed during treatment, said two pillars 7, 8 being used to secure the patient at the sides during compressive massage. The two pillars 7 and 8 can be locked in different fixing positions 10 on the reanimation board 9. The distance between the two pillars 7 and 8 can be adjusted in this way according to the width of the patient's body, in order to secure the patient at the sides. Fixing positions 10 are disposed for this purpose in a plurality of adjacent rows along the longitudinal edges of reanimation board 9.

To prevent the patient from sliding upwards during compressive massage, stop members 15 against which the patient's shoulder regions rest can be locked into additional fixing positions 16. These latter fixing positions 16 are likewise provided in the region of the patient's shoulders in a plurality of rows on reanimation board 9. At the head end of reanimation board 9, a head recess 17 is provided in the form of a hollow.

The portal of the holding device 4 also includes a cross-member 11. Said cross-member 11 is supported vertically adjustably on the two pillars 7 and 8. Cross-member 11 is connected to the top ends of gates 18 that can be slid into pillars 7 and 8. Gates 18 can be locked to pillars 7 and 8 in the respective vertical positions adjusted to the size of the patient's body in the thorax region. Cross-member 11 is adjustable in length. Telescoping cross-member elements 19 are provided for this purpose on a middle section of cross-member 11. The telescoping cross-member elements 19 are preferably connected by articulated joints to the top ends of gates 18. The articulated joints may be embodied in such a way that gates 18, together with pillars 7 and 8, can be folded together on cross-member 11 to form a space-saving arrangement when not in use.

In the middle of cross-member 11, a holder is provided into which an active head 20 can be inserted. Said active head 20 forms an assembly in which a plunger 3 and a drive means for plunger 3 are disposed. Due to the symmetrical longitudinal placement of cross-member 11, said active head can be placed exactly in the middle between the two pillars 7 and 8. However, it is also possible, due to the fact that cross-member 11 can be telescoped, to dispose active head 20 at any other desired place between the two pillars 7 and 8. Plunger 3 and the drive means are disposed at active head 20 in a housing which can be fixed to cross-member 11. The housing can be inserted by a plug connection into the holder provided on cross-member 11 and can be varied in height.

Locking projections are provided for this purpose in a vertical arrangement on the housing and act simultaneously as anti-rotation means 12 due to their linear embodiment. By means of the vertically adjustable plug connection of active head 20 to cross-member 11, active head 20 can be disposed in a neutral position in which a pressure plate 14 provided at the bottom end of plunger 3 rests on the patient's sternum. In this position, the active head 20 is locked to cross-member 11.

In the embodiment shown in FIGS. 4-12, a holding device 5 is provided which comprises a single pillar 32 that extends substantially vertically. A cross-member 31 extending substantially at right angles to said pillar is attached like a cantilever arm thereto. Cross-member 31 is fixed to the top end of pillar 32, which is preferably embodied as a telescopic pillar. The cross-member can be swivelled about a pillar axis forming a vertical axis 57. This swivelling is achieved by the upper end of the pillar being rotatable in relation to the lower part of the pillar, as will be described below.

For reanimation treatment, the base 48 of telescoping pillar 32 is inserted with a base locking plate 58 into recesses in a base plate 39. Plug and snap connections 33 are located on base plate 39 in the region of the recesses. The base locking plate 58 is connected to plug and snap connections 33 by positive engagement in one of the two recesses. In this way, holding device 5 is securely connected to base plate 39. The bottom pillar base 48 and the telescopic part of pillar 32 connected thereto are connected non-rotatingly about vertical axis 57 (pillar axis) to base plate 39. By means of a release mechanism 49, pillar base 48 can be detached from base plate 49. For reanimation treatment, it may suffice to secure the patient to the base plate 39 and to fix the described holding device 5 to base plate 39. The base plate then acts as a reanimation board.

Figure 8:
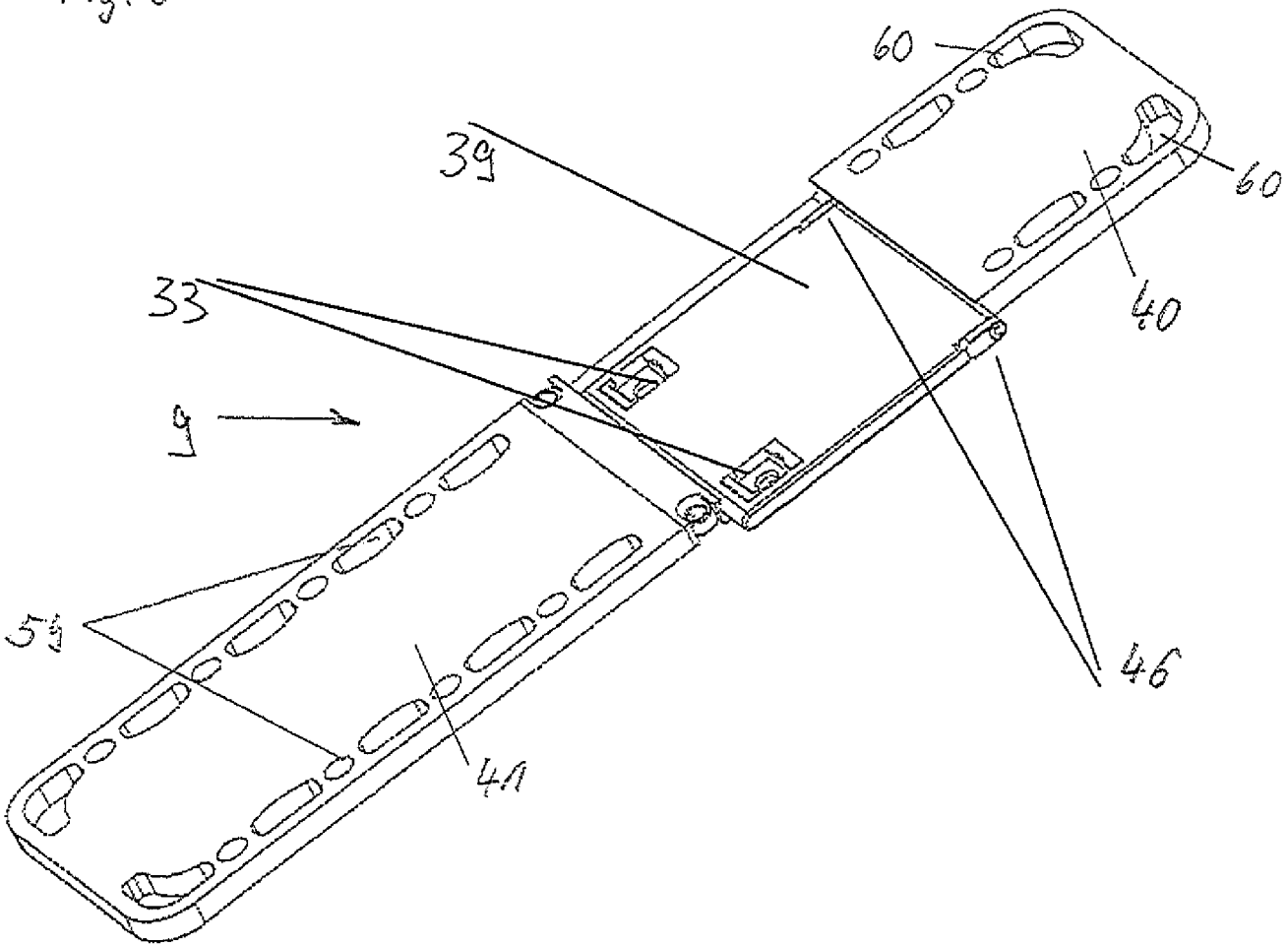
FIG. 8 shows the reanimation board with a partially inserted base plate.
Figure 9:
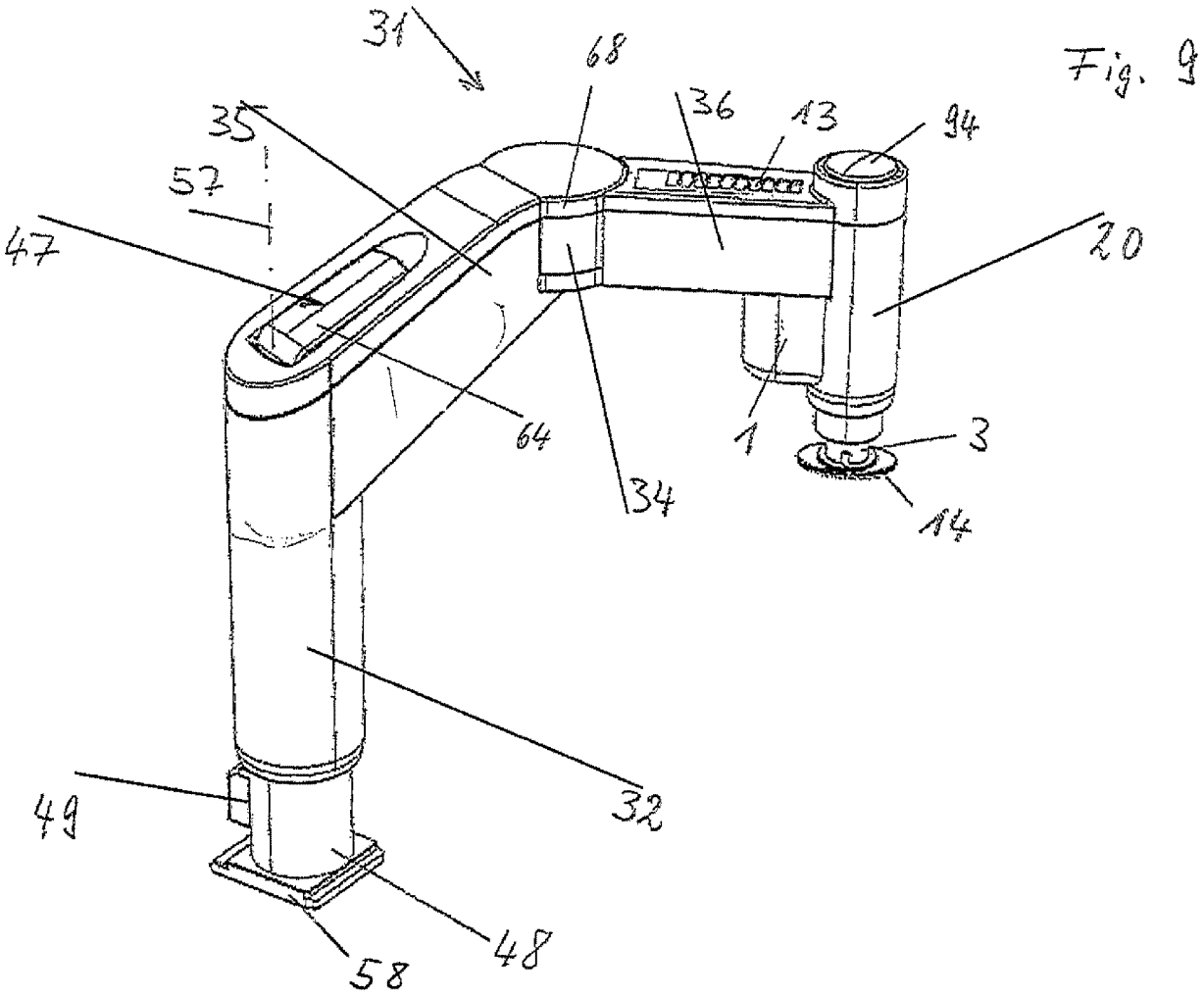
FIG. 9 shows a pillar of the second embodiment with a swivelably configured cross-member.
Figure 10:
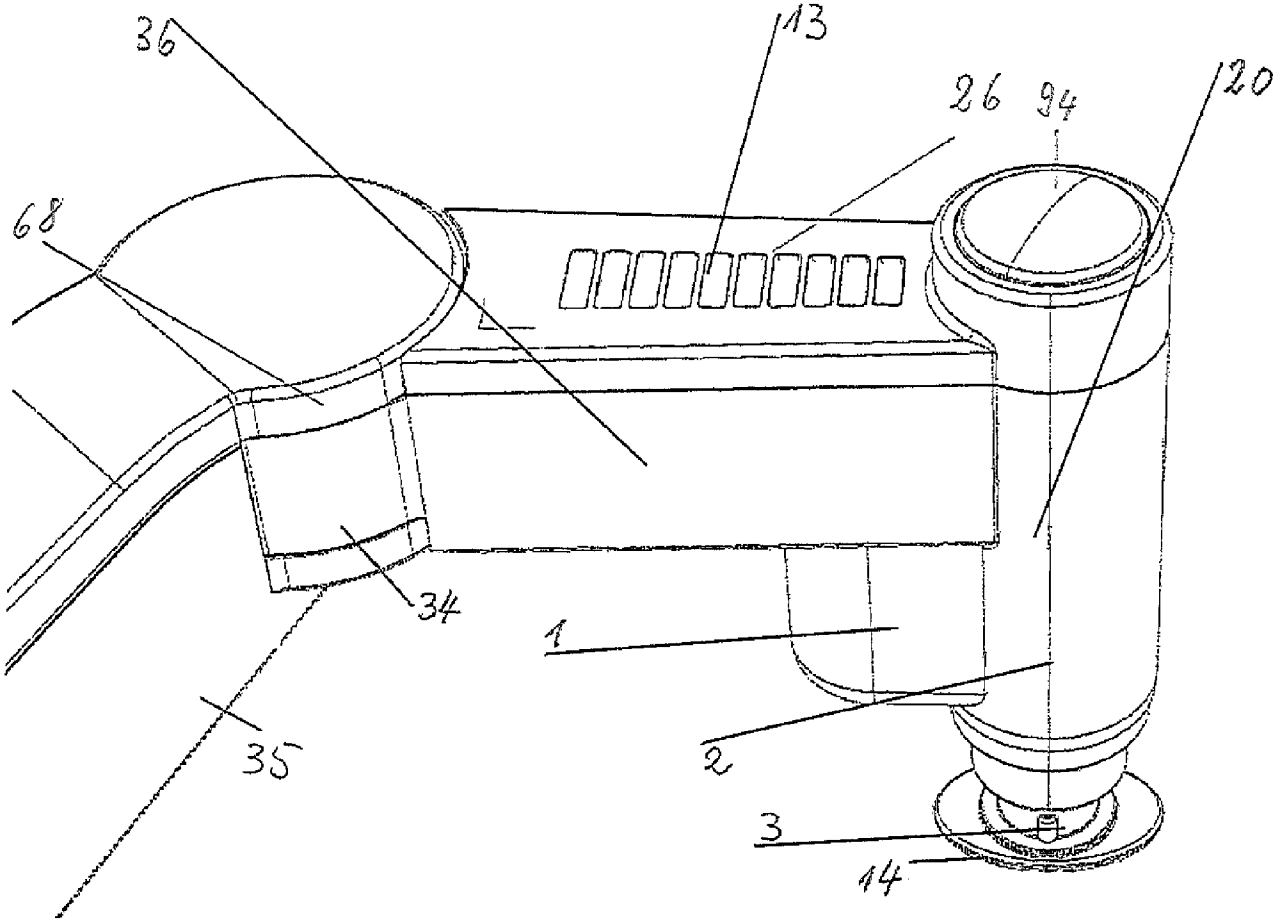
FIG. 10 shows the articulated joint between the two articulated arms of the cross-member and the articulated arms with the drive means.

Base plate 39 can be laterally inserted into a recess 37 (FIG. 5) in reanimation board 9, which in this embodiment may consist of multiple parts or, more particularly, of two parts. Transverse grooves forming a guide mechanism 38 for base plate 37 are used to guide base plate 37. The transverse edges of base plate 37 are held and guided by positive engagement in the grooves of guide device 38. In FIG. 8, base plate 39 is inserted in large part in recess 37. After base plate 39 has been fully inserted, it is locked to reanimation board 9 with the aid of locking levers 46, which are provided laterally at the one end of base plate 39. Reanimation board 9 includes a upper board part 40 and a lower board part 41. Recess 37 is provided on upper board part 40, and snap-in locking for base plate 39 is achieved on upper board part 40 with the aid of the lateral locking levers 46. Locking levers 46 are located at one end of base plate 39, and plug and snap connections 33 for pillar 32 are located at the other end of base plate 39, viewed in the axial direction of the reanimation board.

The upper board part 40 and the lower board part 41 can be securely attached to each other by a plug-in system. Locking pins 43 and a plug-in projection 45 are located for this purpose on the lower board part 41. Plug-in projection 45 is inserted into a plug-in opening 59 on the upper board part during assembly. Locking pins 43 are simultaneously inserted into engagement holes 44 of the upper board part 40. Behind engagement holes 44, snap-locking means 42 with which the locking pins are securely held on rotation in engagement holes 44 are provided in the upper board part. This results in a rigid connection between the upper board part 40 and the lower board part 41. For reanimation treatment, the patient is laid on the assembled reanimation board, and the chest region on which the compressive massage is performed by plunger 3 and pressure plate 14 provided thereon is placed on base plate 39.

Figure 21:
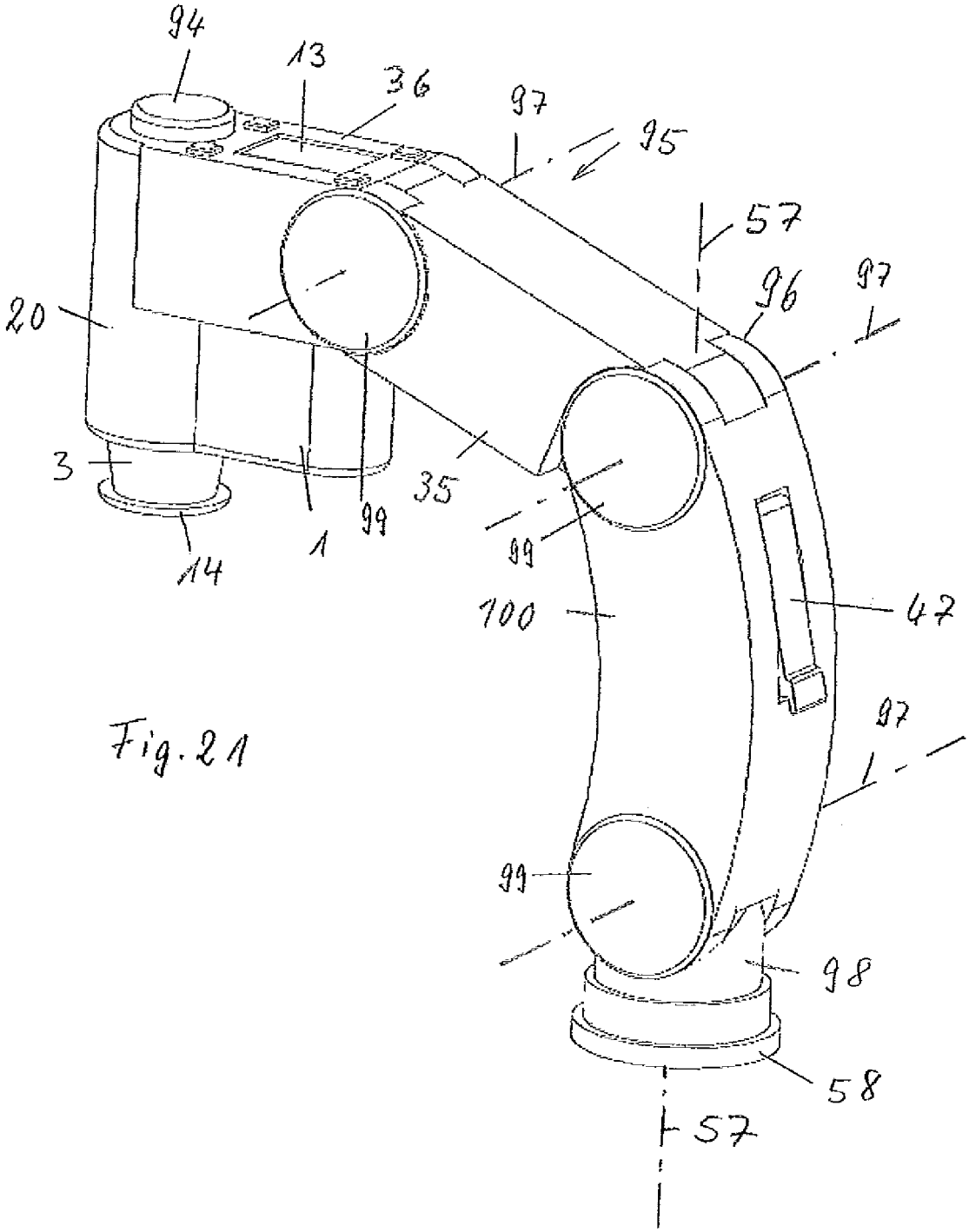
FIG. 21 shows another embodiment of a holding device.
Figure 22:
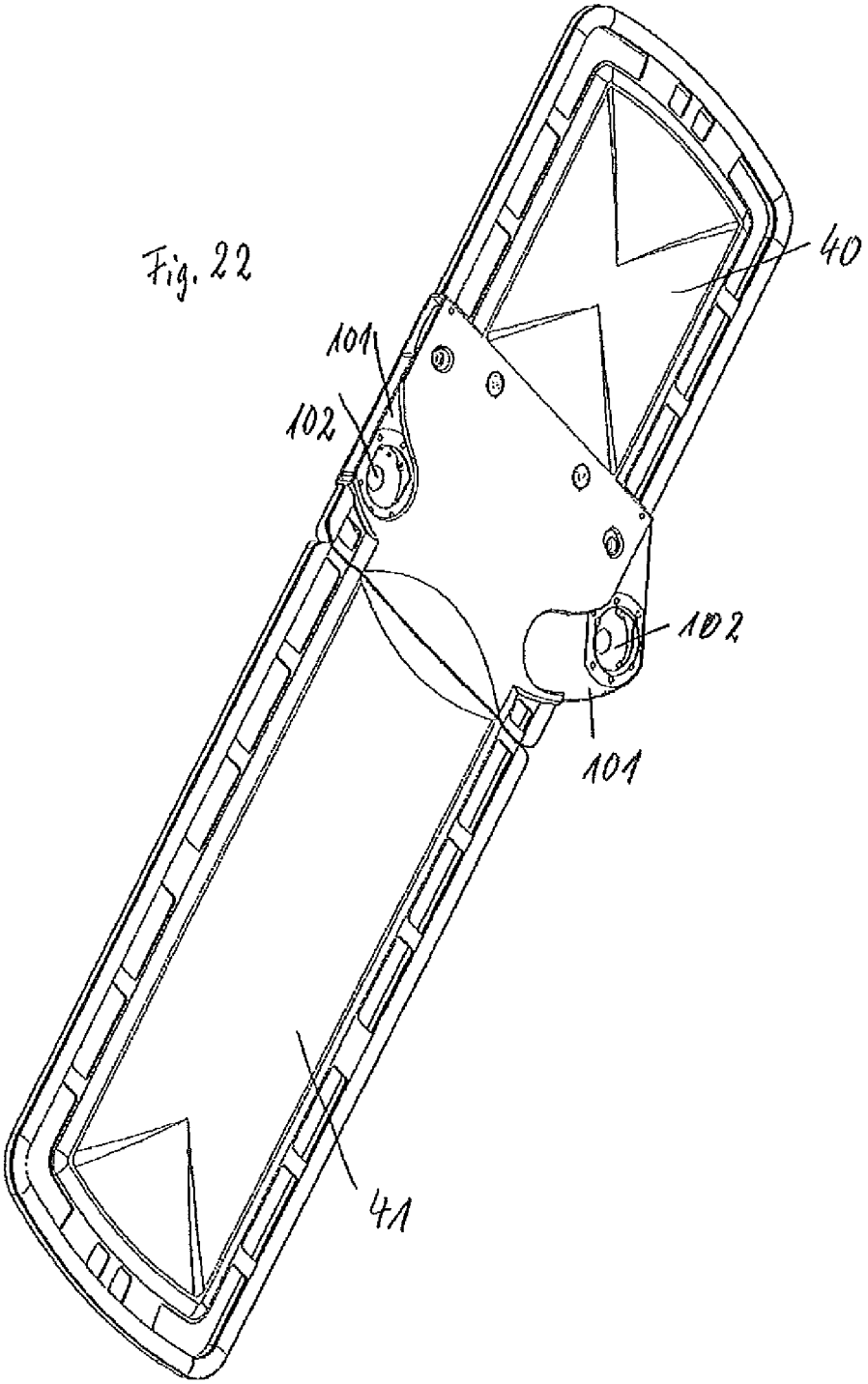
FIG. 22 shows another embodiment for a reanimation board and FIG. 23 shows an embodiment for a pressure plate provided at the bottom end of the plunger.

FIG. 22 shows another embodiment of a reanimation board. Support plates 101 which can be pivoted outwards are provided on both longitudinal sides of the upper board part 40 of said reanimation board. The support plates can be fixed by suitable snap-locking means in a plurality of outwardly pivoted positions. In the embodiment shown, the support plate 101 provided on the right-hand longitudinal side is pivoted outwards. In the embodiment shown, support plates 101 are provided on both longitudinal sides. However, it is also possible to provide just one support plate 101 on one of the two longitudinal sides. Each of the two support plates includes an attachment point 102, in which the holding device, for example pillar 32, is secured by the fixing means described above. The portal-shaped holding device 4 shown in FIGS. 1-3 can also be fixed to attachment points 102 of support plates 101. Attachment points 102 are also suitable for receiving a holding device shown in FIG. 21, which shall be described in more detail below.

The cross-member 31 provided on pillar 32 is designed in such a way that it can be adjusted, in combination with its swivelability about vertical axis 57 (pillar axis), in such a way that the pressure plate 14 provided at the bottom end of plunger 3 can be made to rest on the sternum of the patient. Cross-member 31 is articulated for this purpose and has two articulated arms 35, 36 which are connected to each other in the embodiment shown via an articulated joint 34 having an axis of articulation 63. One articulated arm 35 is pivotably fixed to the top end of pillar 32, and the other articulated arm 36 has the active head 20 with the drive means and plunger 3. In the embodiment shown, articulated arm 35 is pivotably connected to the top part of pillar 32, and the bottom part of the pillar, as already mentioned, can be securely connected to base plate 39 by designing the pillar base 48 accordingly. By virtue of the articulated design of cross-member 31 and its pivotability about vertical axis 57 (pillar axis), the pressure plate 14 provided at the bottom end of plunger 3 can be laid on the chest region on which compressive massage is be performed. Holding device 5 can be adjusted to the desired height in that regard due to the telescopic design of pillar 32.

Articulated joint 34 is locked in this position, so the two articulated arms 35 and 36 are rigidly connected to each other. Pivotability about vertical axis 57 (pillar axis) is simultaneously locked, for example with the aid of a locking mechanism 61 which is provided in pillar 32 and which will be described further below with reference to FIGS. 15 and 16. This locking can preferably be performed with the aid of a central locking mechanism 47 which is provided at the top end of pillar 32 and which will be described further below with reference to FIGS. 15 and 16.

In this locked state, the two articulated arms 35, 36, pillar 32 and base plate 39 form a rigid structure which absorbs, by positive engagement, the forces arising when the compressive massage is performed on the patient. On the lateral longitudinal edges of upper board part 40 and on lower board part 41, attachment points 59, 60 are provided, for example in the form of holes, to which securing straps for securing the patient on the board as well as stop members 15 in the shoulder region of the patient can be detachably fixed.

Central locking mechanism 47 is provided to lock the two articulated arms 35, 36 in relation to each other and to block any rotation about vertical axis 57 (pillar axis) of cross-member 31 or of the articulated arm 35 connected to pillar 32. This central locking mechanism is shown in more detail in FIGS. 15-18. It has two operating levers 79, 80, which are pivotably connected to each other at a connection point 78. Connection point 78 acts like a toggle joint between the two operating levers 79, 80. Operating lever 79 is used to operate a joint lock mechanism 62 with which the articulated joint 34 between the two articulated arms 35, 36 is blocked or locked against rotation, as will be described in more detail below. Actuating lever 80 is connected via a push rod 76 to a locking mechanism 61 which acts like a locking mechanism and blocks articulated arm 35 and hence the entire cross-member 31 against rotation about vertical axis 57.

The connection point 78 between the two operating levers 79, 80 is in active engagement with a control cam 77 mounted rotatably on articulated arm 35. Control cam 77 has two detent positions in which it interacts with connection point 78. In the detent point shown in FIGS. 15, 16, locking mechanism 61 and joint lock mechanism 62 are released. In this position, articulated arms 35, 36 can be turned in relation to each other, and articulated arm 35 and hence the entire cross-member 31 can be swivelled about pillar axis 57.

In the second position, which is shown in FIGS. 17, 18, locking mechanism 61 and joint lock mechanism 62 are in their blocking position, with the result that the two articulated arms 35, 36 are connected together non-rotatingly about articulated joint 34. Articulated arm 35 and hence cross-member 31 are also blocked against rotating about pillar axis 57.

In order to operate control cam 77, a lever 64 is provided that can be manually pivoted between the two positions shown in FIGS. 16, 18. In this way, control cam 77 is brought into the two positions in which the central locking mechanism is opened (FIGS. 15, 16) and in which the locking mechanism is closed (FIGS. 17, 18).

The joint lock mechanism 62 has a slider 66 which has locking teeth 67 on the side facing articulation joint 34. The slider can be moved longitudinally in a slider guide 70 fixed to articulated arm 35. The sliding movement runs perpendicularly to the axis of articulation 63 of articulated joint 34. A pressure spring 69 which is supported at a support point 81 adapted to the cross-section of the spring and which can be plate-shaped in design acts on slider 66. Support point 81 is fixed to articulated arm 35. Slider 66 is connected to operating lever 79 in an articulated joint 82. In the position shown in FIGS. 15, 16, the joint lock mechanism 62 is in its opened position. This is achieved by moving slider 66 away from articulated joint 34, so that locking teeth 67 are removed from engagement with respective locking teeth on a rotating joint member 68 (FIGS. 9, 10) which is fixedly connected to articulated arm 36. Said position is shown in FIGS. 15, 16. In this position, the two articulated arms 35, 36 can be pivoted in relation to each other about axis of articulation 63.

When moving lever 64 anti-clockwise out of the position in FIGS. 15, 16 into the position shown in FIGS. 17, 18, control cam 77 and thus connection point 78 are brought into positions in which pressure spring 69 moves slider 66 towards articulation axis 63, in which position locking teeth 67 come into engagement with respective locking teeth on rotating joint member 68, which is fixedly connected to articulated arm 36. In this position, the two articulated arms 35, 36 are blocked against any further rotation. The two articulated arms are now in a preselected pivot angle in relation to each other.

Pivoting lever 64 simultaneously causes operating lever 80 to move between the two positions that are shown in FIGS. 15, 16 and 17, 18. Operating lever 80 is pivotably supported on a rotatable part 84. Rotatable part 84 is fixedly connected to articulated arm 35 and can be rotated about pillar axis 57 when the central locking mechanism 47 is in the position shown in FIGS. 15, 16. Operating lever 80 is mounted in a lever axis 85 on a support 86 on rotatable part 84. One end of the lever is rotatably connected at a hinging point 87 to the top end of push rod 76. The bottom end of the push rod is fixedly connected to a ring holding part 75. Push rod 57 is guided through another ring holding part 74, and an elastically deformable locking ring 73 is held between the two ring holding parts 74, 75. The lower ring holding part 75 can be moved by push rod 76 against the upper ring holding part 74 in the axial direction relative to pillar axis 57. In the position shown in FIGS. 15, 16, the lower ring holding part 75 is in its lower position, in which the rotatable part and thus cross-member 34 with the two articulated arms 35, 36 can be rotated or swivelled, respectively, about vertical axis 57. When setting lever 74 to the position shown in FIGS. 17, 18, push rod 76 is moved upward by the movement of operating lever 18, with the result that the distance between the two ring holding parts 74, 75 is reduced and the deformable locking ring 73 is compressed, thus preventing any rotation about vertical axis 57. In the process, the deformed locking ring 73 is pressed with increased force (F) against the inner wall of pillar base 48 and also against the contact surfaces on the two ring holding parts 74, 75, thus preventing any rotation of these parts in relation to each other. As can be seen from the Figures, the upper ring holding part 74 is fixedly connected by a telescopic part 72 to rotatable part 84 and thus fixedly to articulated arm 35. This causes articulated arm 35 to be blocked from rotation relative to pillar base 48 and thus from rotation about vertical axis 57.

Telescopic part 72 is mounted displaceably in relation to pillar base 48 for vertical adjustment of pillar 32 and thus of cross-member 31. When the central locking mechanism 47 is released (FIGS. 15, 16), vertical adjustment and rotation are possible. The components of locking mechanism 61 are moved as well via push rod 46, with the result that locking mechanism 61 not only blocks rotation of cross-member 31, but also secures the adjusted height when central locking mechanism 47 is closed (FIGS. 17, 18).

In the embodiment shown, telescopic part 72 and pillar base 48 are tubular in design and are disposed moveably in relation to each other when central locking mechanism 47 is released. This permits vertical adjustment of the pillar and also of plunger 3. Vertical adjustment can be carried out manually, pneumatically or hydraulically.

The embodiment of a holding device 95 shown in FIG. 21 includes an arc-shaped support 96. The latter extends substantially along a 90° arc from an articulated joint member 98 which can be supported on reanimation board 9. Arc-shaped support 96 has a plurality of articulated arms 35, 36 and 100 which are connected to each other by articulated joints having horizontal axes of articulation 97. Arc-shaped support 96, which can be fixed by its articulated joint member 98 to the reanimation board, can be swivelled about vertical axis 57 when locking mechanism 47 is released. In combination with the pivotability in articulated joints 99 and due to any vertical adjustability of active head 20, suitable adaptation to the size of the patient's body is achieved. With the aid of the central locking mechanism 47, the two articulated arms 35 and 100 can be locked into a desired angular position, as in the embodiment shown in FIGS. 15-18, and the articulated joint member 98 can be blocked against rotating in relation to base locking plate 58 about vertical axis 57. The articulated joint 99 between the two articulated arms 35 and 36 can also be blocked by frictional or positive engagement against rotation, so that the direction of movement of plunger 3 and pressure plate 14 extends in the vertical direction.

Figures 19, 20:
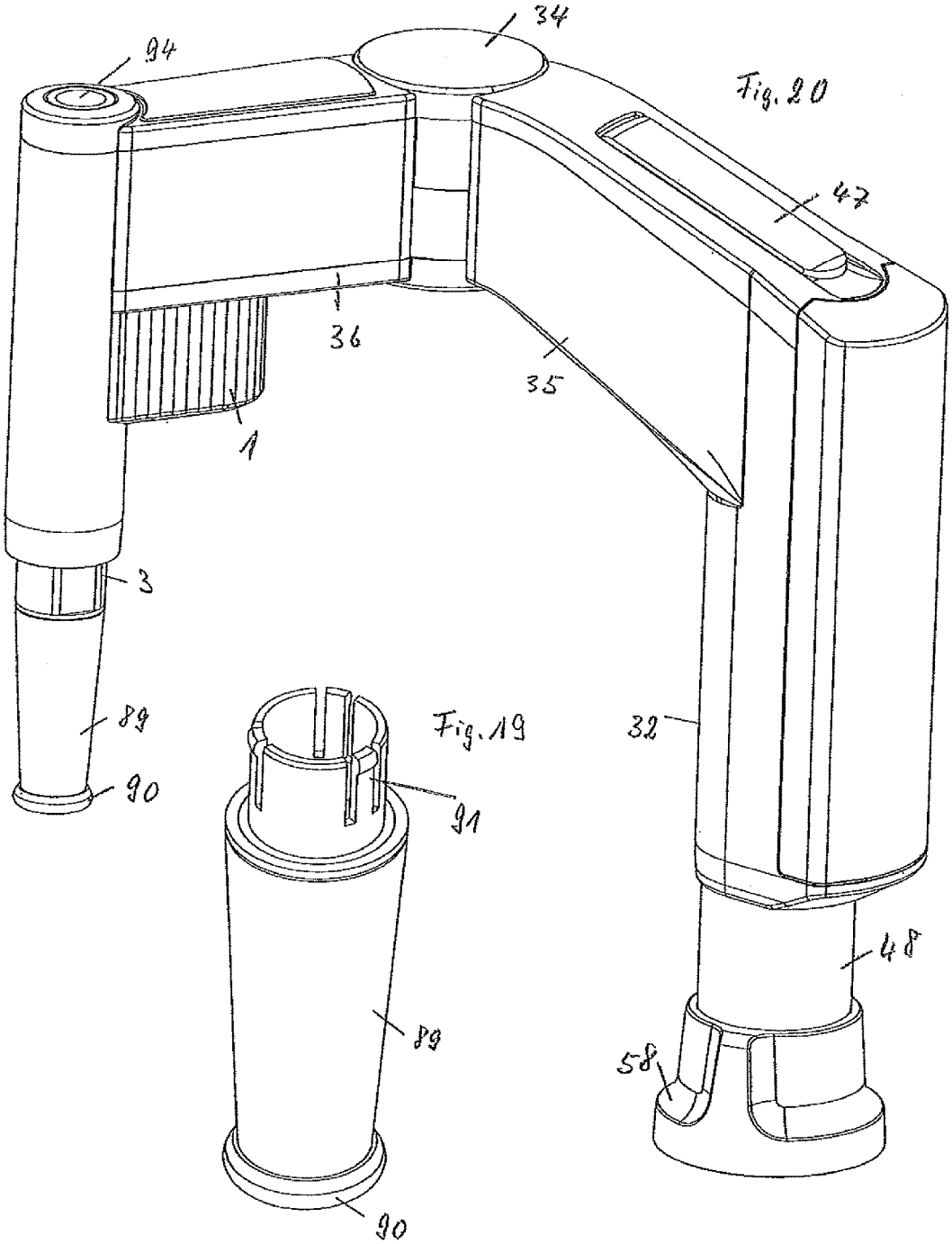
FIG. 19 shows a reducing plunger.
FIG. 20 shows the embodiment with the reducing plunger fitted.

In FIG. 19, a reducing plunger 89 is shown. At its top end, said reducing plunger has snap-locking means 91 with which reducing plunger 89 can be detachably fixed to the bottom end of the plunger driven by electric motor 1, as shown in FIG. 20. A pressure plate 90 is provided at the bottom end of reducing plunger 89. Reducing plunger 89 is used for treating children and forms an additional compression member which is detachably fixed to the bottom end of plunger 2 in place of pressure plate 14.

Figure 23:
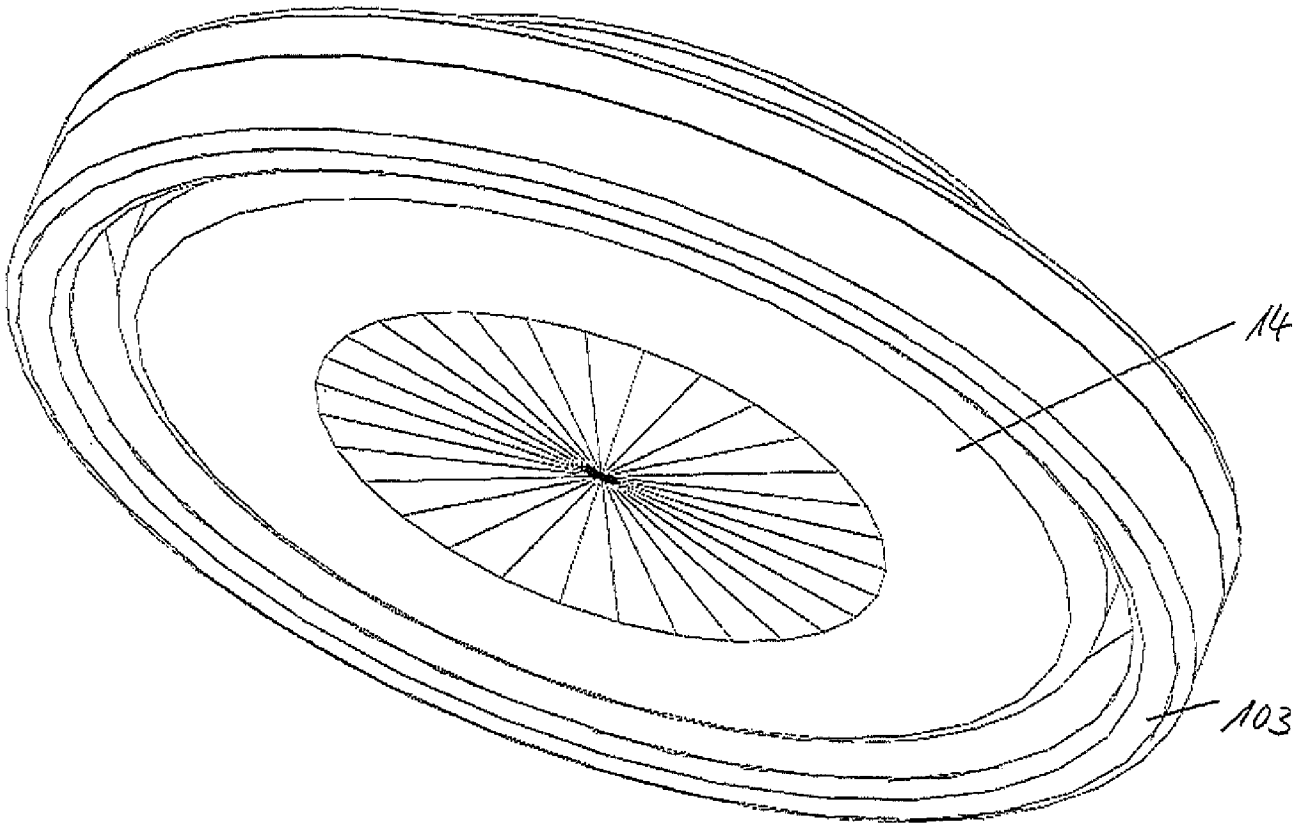

FIG. 23 shows an embodiment of pressure plate 14, which is disposed at the bottom end of plunger 3. Said pressure plate has a circumferential gas-tight seal 103. When pressure plate 14 is placed on the patient's body, underpressure can be produced in the space enclosed between the patient's body and pressure plate 14 by the seal 103. This underpressure can be produced with the aid of a pump (not shown) that is connected via a suitable pipeline to the interior space enclosed by the seal.

Figure 11:
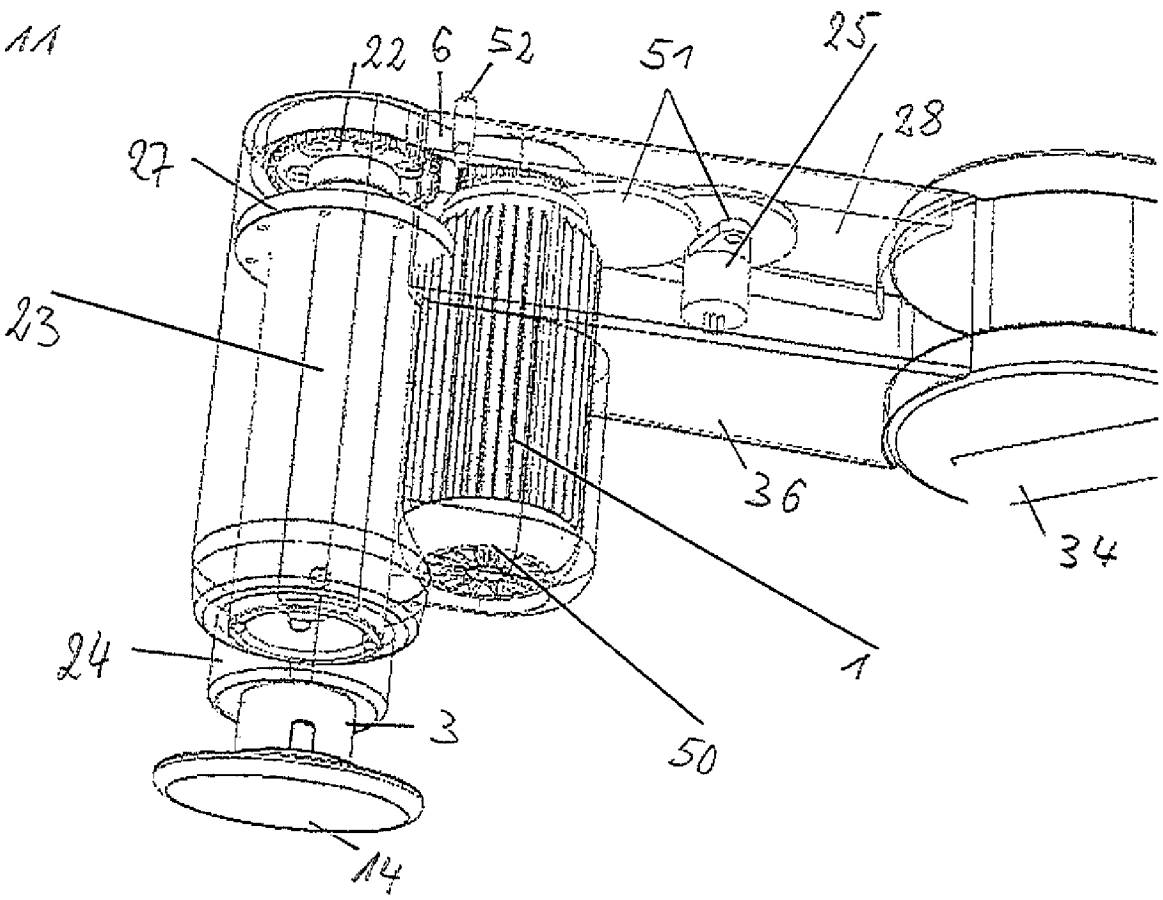
FIG. 11 shows components of the drive means that are used in the embodiment.
Figure 12:
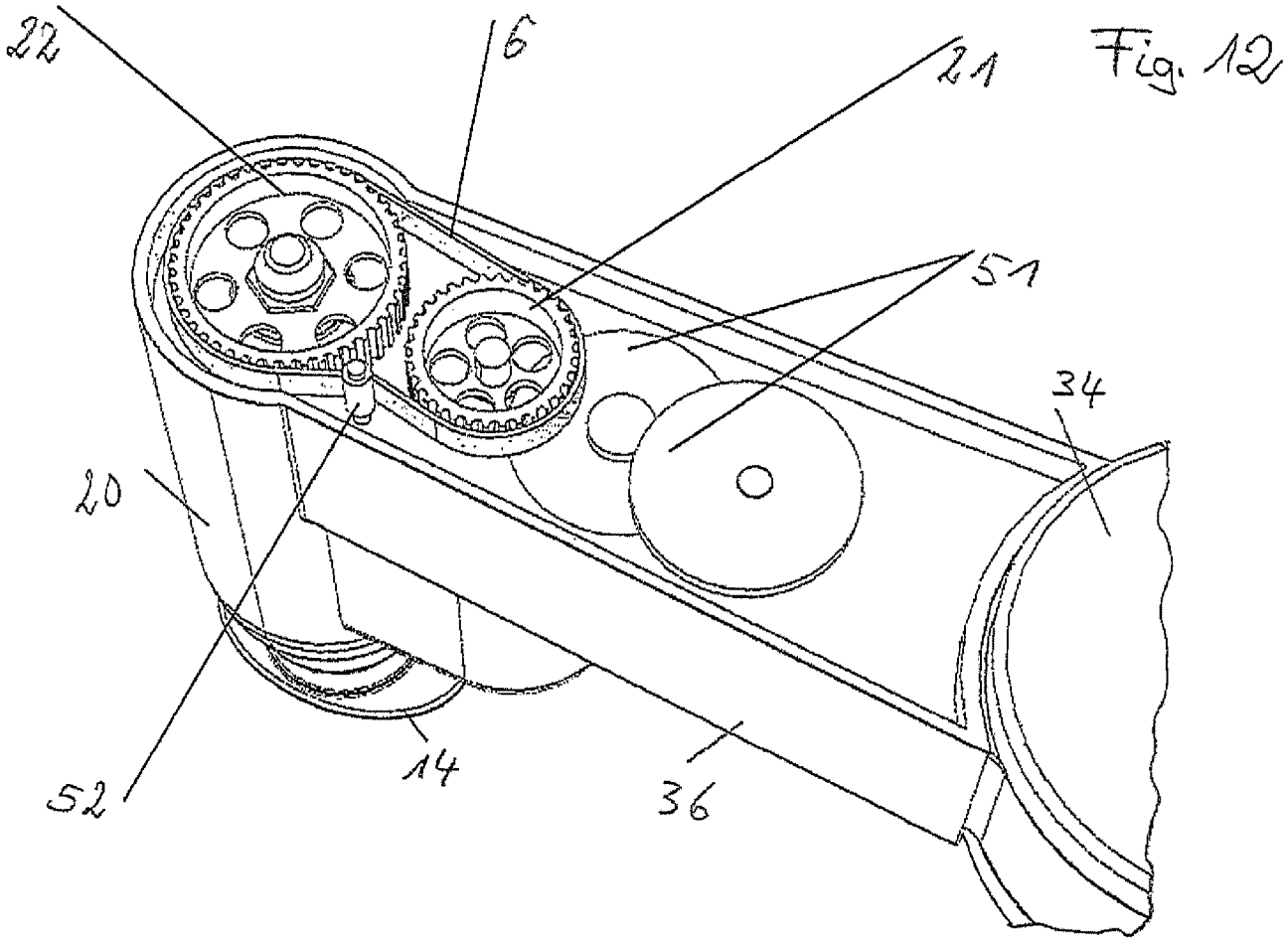
FIG. 12 shows the upper part of the drive means.

The drive means for plunger 3 includes an electric motor 1, the torque of which is converted via a transmission gear 2 into the back-and-forth compressive massage motion of plunger 3. The rotational movement of the motor armature 104 is transferred via a gear wheel 21 connected to the motor shaft and via a drive belt 6 to a gear wheel 22 provided on transmission gear 2. The rotation of the motor, which is preferably a reversing rotational movement, is transferred to transmission gear 2 via the toothed belt drive formed in the manner described above. Transmission gear 2 is embodied in such a way that the rotational movement transferred by the toothed belt drive is converted into a linear back-and-forth movement for the plunger 3. In this regard, the transmission gear may have a plunger 3 which can be extended by a ball screw spindle 23, a ball screw nut mounted in rubber and which engages with the ball screw spindle being provided at the top end of plunger 3. At its bottom end, plunger 3 is guided in a sliding bearing 24 which is fixed to the bottom end of the housing that forms holding device 5 (FIG. 11). A trapezoidal screw may also be used. A belt tightener rests tangentially against drive belt 6. A rotary transducer 51 embodied as a gear transmission detects the rotational movement transferred by drive belt 6. In this way, it is possible to detect the respective absolute position of plunger 3. Rotary transducer 51 interacts with a position measuring device 25, which may be embodied as an angle encoder. The respective rotation angle position of the motor armature 104, or the position of the drive belt or also of gear wheel 22 and thus the respective position of plunger 3 can be detected in absolute terms in this manner. The respective stroke length of plunger 3 can also be detected directly at the motor, in particular at the motor armature 104 or at plunger 3. Instead of the transmission consisting of a toothed belt and gear wheels, a transmission consisting only of gear wheels can also be used.

Transmission gear 2, with its ball screw and motor 1, can be fixed to a flange plate 27 that can be attached to the free end of articulated arm 36. In the embodiment shown in FIGS. 1-3, flange plate 27 can be attached to the middle cross-member element 19.

A circumferentially sealing cover 28 can be placed on flange plate 27. On its inner side, said cover 28 may have a printed circuit board with a start/stop button for starting and stopping compressive massage treatment. In addition, light-emitting diodes forming a display device 13 on the inner side of transparent cover 25 may be arranged in the form of a lightbar 26. This display device can display, with different colours of light-emitting diodes, whether the reanimation phase or the artificial respiration phase is running. The cover is transparent in design, at least in the region of the lightbar display of display device 13. During treatment of the patient, display device 13 is easily seen from everywhere by the person delivering the treatment, thus making it easier to monitor the progress of treatment.

Figure 13:
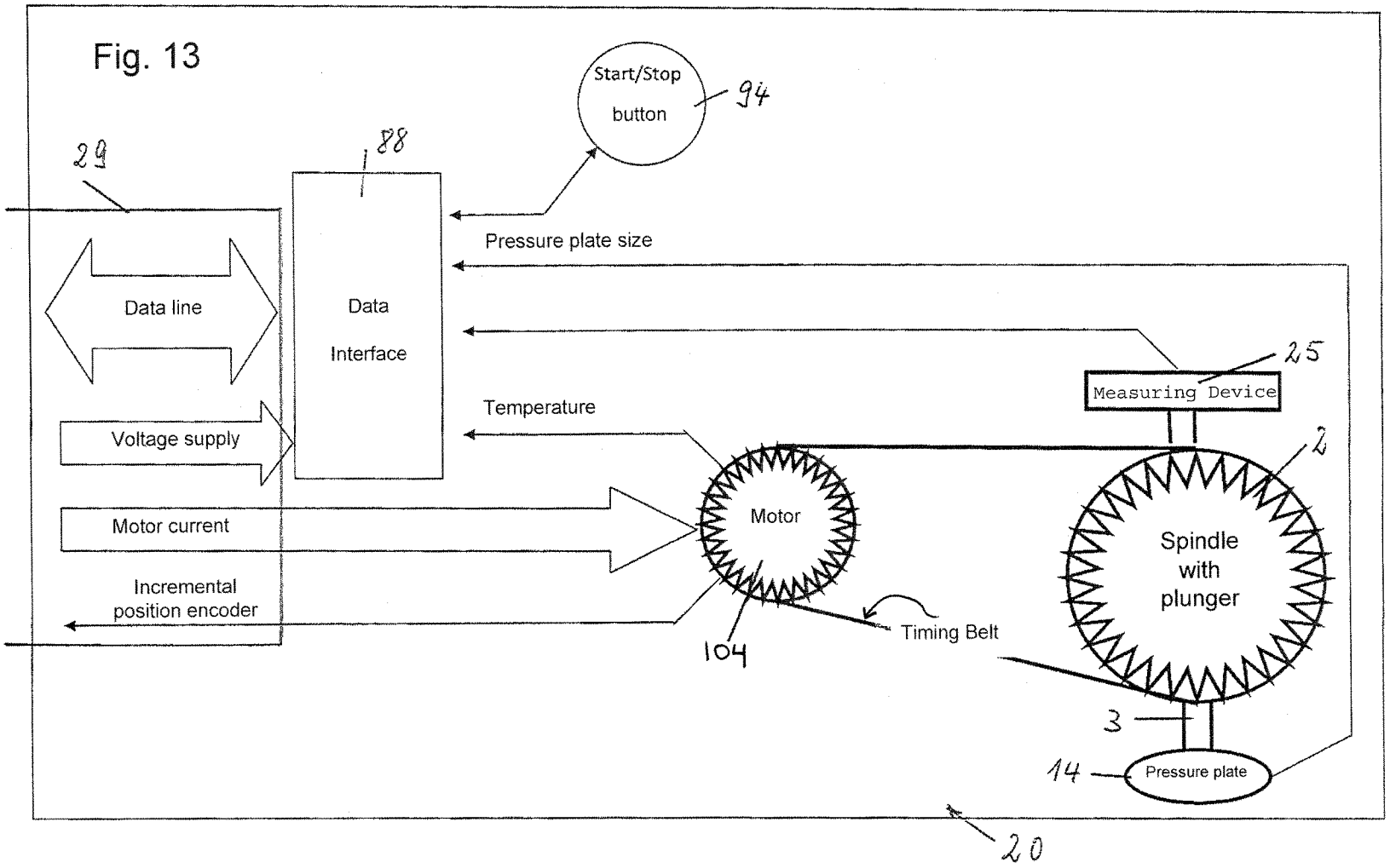
FIG. 13 shows a schematic block diagram for describing the power control system for the drive means in the embodiments.
Figure 14:
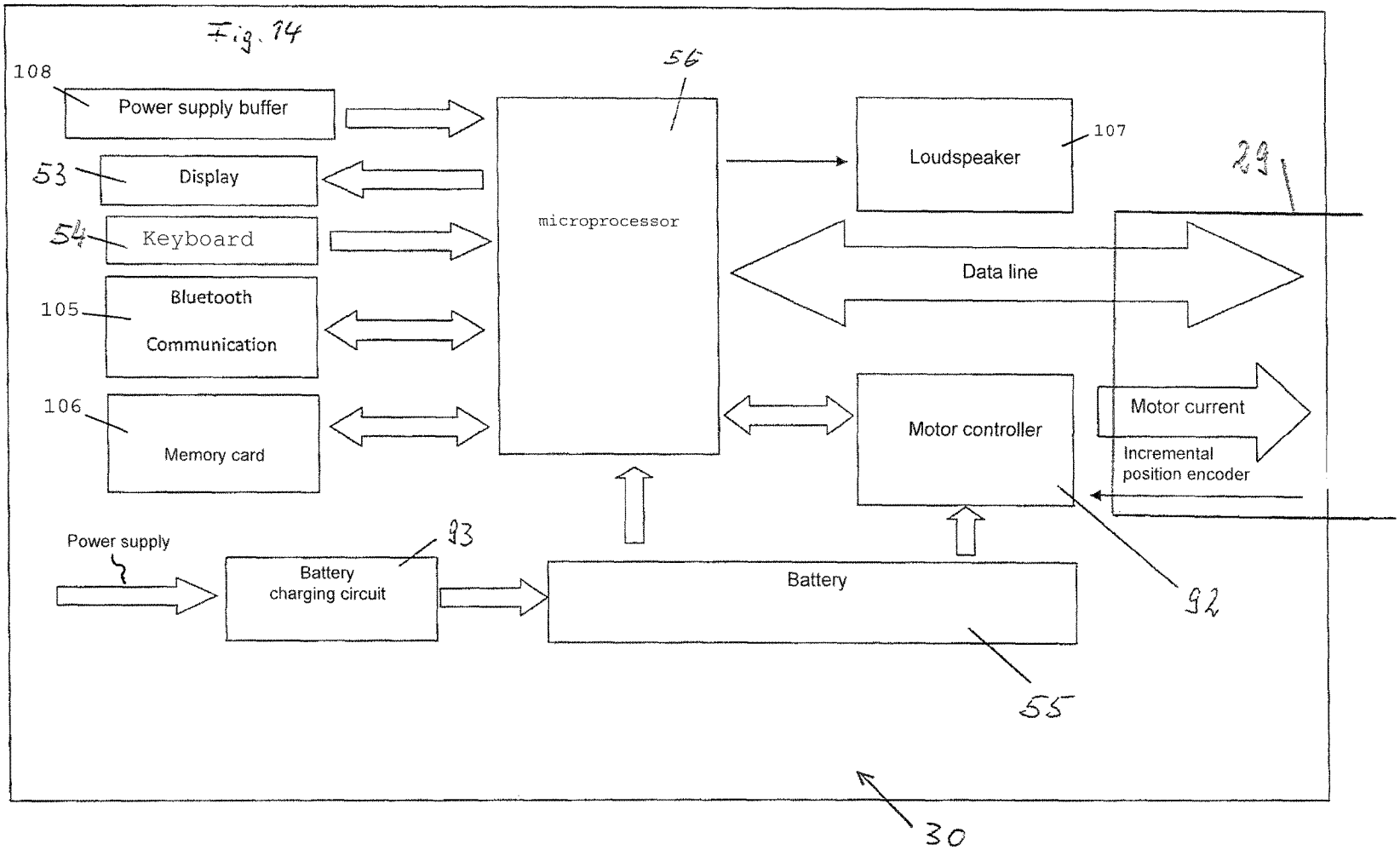
FIG. 14 shows a block diagram for a controller which can be used in the embodiments.

The connection between the drive means in active head 20, as shown in FIG. 13, and controller 30, a block diagram of which is shown in FIG. 14, is established by means of a schematically represented connecting cable 29. With the aid of a keyboard 54, it is possible to operate all the essential controls at controller 30, such as start, stop, stroke frequency and stroke depth of the plunger, and to activate predefined logs. Controller 30 can be installed in cross-member 31, for example in articulated joint 34. However, it may also be embodied as a separate device which can be detachably mounted on cross-member 31, if necessary. Connecting cable 29 can contain the data line between a data interface 88 for the electrical systems of the active head (FIG. 13) and a microprocessor 56 in controller 30, as well as the voltage supply for the data interface. However, the data can also be transmitted wirelessly. Also shown in FIG. 14 as being connected to microprocessor 56 is Bluetooth communication module 105, memory card 106, loudspeaker 107, and power supply buffer 108. The motor current for the electric motor 1 and signals from an incremental position encoder indicating the rotation angle position of electric motor 1 may also be supplied via connecting cable 29. Power is supplied to electric motor 1 via connecting cable 29 from a battery 55 or from a rechargeable accumulator. The progress of treatment can be displayed on a screen 53. Connecting cable 29 can be connected to controller 30 by a plug.

The motor current is supplied to electric motor 1 from battery 55 or the rechargeable accumulator via a motor controller 92. The battery may be located inside controller 30 or preferably outside the controller in cross-member 31 and particularly in articulated arm 35 below locking mechanism 47. The battery 55 or accumulator can be charged via a charging circuit 93 accommodated inside controller 30. The charging current can be supplied from an external source of current, for example from the alternator of a motor vehicle or from the power grid. The respective charge state of the battery or accumulator can be indicated via microprocessor 56 on display 53.

A switch, preferably in the form of a pushbutton switch 94 which is disposed on or in the immediate vicinity of active head 20, is used to start and stop treatment of the patient. The motor current fed to electric motor 1 is switched on by means of pushbutton switch 94. Said pushbutton switch 94 interacts with locking mechanism 47 in such a way that treatment of the patient can only be started with pushbutton switch 94 when the locking mechanism is in its blocking position (FIGS. 17, 18). More particularly, the motor current can only be switched on when locking mechanism 47 is in its blocking position (FIGS. 17, 18). Locking mechanism 47 can interact with pushbutton switch 94 by mechanical means, for example a suitably releasable lock, or microprocessor 56 detects the respective position of locking mechanism 47 and releases the supply of current via motor controller 92 to motor 1 only when locking mechanism 47 is in its blocking position. When, after starting treatment of the patient, pushbutton switch 94 is pressed in order to stop treatment, electric motor 1 is controlled in such a way that plunger 3 is returned to the starting position from which it was released by the patient. This is done with the aid of the suitably programmed microprocessor 56 and with the aid of motor controller 92. All that is preferably required to operate the apparatus is a switch, in the form of pushbutton switch 94 having one direction of actuation for switching on and switching off.

The stroke length of plunger 3 can be monitored by position measuring device 25 and correlated via microprocessor 56 and motor controller 92 with the signals from the incremental position encoder, wherein the signals from the incremental position encoder can be made to match the desired stroke length by the motor controller. A specific force profile for treatment of the patient may also be predefined in microprocessor 56. Said force profile can then be correlated with the supply current drawn by the motor, which is proportional to the torque delivered by the motor, and the current supplied to the motor can then be controlled by motor controller 92.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

| List of reference signs | |
|---|---|
| 1 | Electric motor |
| 2 | Transmission gear |
| 3 | Plunger |
| 4 | Holding device |
| 5 | Holding device |
| 6 | Drive belt |
| 7, 8 | Pillars |
| 9 | Reanimation board |
| 10 | Fixing positions |
| 11 | Cross-member |
| 12 | Anti-rotation means/vertical adjuster |
| 13 | Display device |
| 14 | Pressure plate |
| 15 | Stop members |
| 16 | Fixing positions |
| 17 | Head recess |
| 18 | Gate |
| 19 | Cross-member elements |
| 20 | Active head |
| 21, 22 | Gear wheels |
| 23 | Ball screw |
| 24 | Sliding bearing |
| 25 | Position measuring device |
| 26 | Lightbar |
| 27 | Flange plate |
| 28 | Cover |
| 29 | Connector cable |
| 30 | Controller |
| 31 | Cross-member |
| 32 | Pillar |
| 33 | Plug and snap-lock connection |
| 34 | Articulated joint |
| 35, 36 | Articulated arms |
| 37 | Recess |
| 38 | Guide mechanism |
| 39 | Base plate |
| 40, 41 | Board parts |
| 42 | Snap-locking means |
| 43 | Locking pins |
| 44 | Engagement holes |
| 45 | Plug-in projection |
| 46 | Locking lever |
| 47 | Locking mechanism |
| 48 | Foot of pillar |
| 49 | Release mechanism |
| 50 | Fan |

-continued

| List of reference signs | |
|---|---|
| 51 | Rotary transducer |
| 52 | Belt tightener |
| 53 | Screen |
| 54 | Keyboard |
| 55 | Battery/accumulator |
| 56 | Microprocessor |
| 57 | Vertical axis |
| 58 | Base locking plate |
| 59 | Plug-in opening |
| 59, 60 | Attachment points |
| 61 | Locking device |
| 62 | Joint lock mechanism |
| 63 | Axis of articulation |
| 64 | Lever |
| 65 | Lever axis |
| 66 | Slider |
| 67 | Locking teeth |
| 68 | Reanimation board |
| 69 | Spring |
| 70 | Slider guide |
| 72 | Telescopic part |
| 73 | Locking ring |
| 74, 75 | Ring holding parts |
| 76 | Push rod |
| 77 | Control cam |
| 78 | Connecting point |
| 79, 80 | Actuating lever |
| 81 | Support point |
| 82 | Articulated joint |
| 83 | Locking teeth |
| 84 | Rotatable part |
| 85 | Lever axis |
| 86 | Support |
| 87 | Hinging point |
| 88 | Data interface |
| 89 | Reducing plunger |
| 90 | Pressure plate |
| 91 | Snap-locking means |
| 92 | Motor controller |
| 93 | Charging switch |
| 94 | Pushbutton switch |
| 95 | Holding device |
| 96 | Arc-shaped support |
| 97 | Axes of articulation |
| 98 | Articulated joint member |
| 99 | Articulated joint |
| 100 | Articulated arm |
| 101 | Support plate |
| 102 | Attachment point |
| 103 | Circumferential seal |
| 104 | Armature |
| 105 | Bluetooth Communication |
| 106 | Memory card |
| 107 | Loudspeaker |
| 108 | Power supply buffer |

What is claimed is:

1. An apparatus for reanimation of a patient, comprising:

a plunger;

an electric motor configured to drive the plunger and to perform a compressive massage on a patient's body;

a holding device for the electric motor and the plunger; and a reanimation board, wherein the holding device includes a vertically adjustable cross-member on which the electric motor and the plunger are mounted, and which is supported on the reanimation board, wherein the vertically adjustable cross-member is supported on one pillar, wherein the vertically adjustable cross-member is articulated and has at least two articulated arms that are connected to each other by an articulated joint having an axis of articulation, wherein a central lock fixes the two articulated arms in specific angular positions relative to each other in a plane perpendicular to the axis of articulation, wherein one of the articulated arms is rotatably mounted about a vertical axis of the one pillar, wherein the axis of articulation is parallel to the vertical axis of the one pillar, and wherein the central lock also fixes the cross member in a specific angular position about the vertical axis of the one pillar.

2. The apparatus according to claim 1, wherein the one pillar is attachable to the reanimation board on which the patient lies.

3. The apparatus according to claim 1, wherein the holding device and the reanimation board form a force-locked structure that absorbs forces exercised by the plunger during compressive massage.

4. The apparatus according to claim 1, wherein the holding device is detachably fixed to the reanimation board by a plug and snap connection.

5. The apparatus according to claim 1, wherein the holding device is moveable in a longitudinal direction in relation to the reanimation board or is fixable in different positions.

6. The apparatus according to claim 1, wherein the reanimation board includes two detachable parts.

7. The apparatus according to claim 1, wherein the reanimation board includes a recess for a base plate on which the one pillar is securable.

8. The apparatus according to claim 7, wherein a guide mechanism for lateral insertion of the base plate is provided in a region of the recess.

9. The apparatus according to claim 7, wherein the holding device and the base plate or at least one support plate to which it is connected form a force-locked structure that absorbs the forces exercised by the plunger during compressive massage.

10. The apparatus according to claim 1, wherein at least one support plate is pivotably mounted on the reanimation board, said at least one support plate being pivotable away from the reanimation board and comprising an attachment point for the holding device.

11. The apparatus according to claim 10, wherein the at least one support plate is lockable in different pivot angle positions.

12. The apparatus according to claim 1, wherein the plunger is configured for detachably attaching a reducing plunger to a bottom end of the plunger, the reducing plunger configured for treatment of children.

13. The apparatus according to claim 1, wherein a circumferential gas-tight seal is provided on a pressure plate and under-pressure is produced in a space enclosed between the patient's body and the pressure plate by the seal.

14. The apparatus according to claim 1, wherein a torque of the electric motor is converted via a transmission gear into the compressive massage motion of the plunger.

15. The apparatus according to claim 14, further comprising a locking mechanism configured to release a power supply to the electric motor.

16. The apparatus according to claim 14, wherein the motor includes a position measuring device configured to detect a rotation angle position of the motor, or a position of a transmission part, and is employed for determining the position of the plunger during its compressive massaging motion.

17. The apparatus according to claim 16, wherein the transmission part is a drive belt or gear wheel configured to transfer a rotational movement of the electric motor.

18. The apparatus according to claim 14, further comprising a control unit configured to control the electric motor by comparing a motor current drawn by the electric motor with a current profile corresponding to a predefined force profile for a stroke length of the plunger.

19. The apparatus according to claim 18, wherein a number of revolutions of the motor in a respective direction of rotation is adjusted by the control unit according to the predefined force profile.

20. The apparatus according to claim 18, wherein a motor speed is adjusted by the control unit according to the predefined force profile.

21. The apparatus according to claim 1, further comprising a display device configured to display a reanimation process, the display device being provided on the holding device.

22. The apparatus according to claim 21, wherein the display device is a light-bar.

23. The apparatus according to claim 1, further comprising a pushbutton switch with a single direction of switch actuation to operate the apparatus during treatment of the patient.

* * * * *